US009097485B2

(12) United States Patent
Lipowski

(10) Patent No.: US 9,097,485 B2
(45) Date of Patent: Aug. 4, 2015

(54) TRIGGER ASSEMBLY

(71) Applicant: 2360216 Ontario Inc., Toronto (CA)

(72) Inventor: Mats Lipowski, Toronto (CA)

(73) Assignee: 2360216 ONTARIO INC., Toronto, Ontario (CA)

( * ) Notice: Subject to any disclaimer, the term of this patent is extended or adjusted under 35 U.S.C. 154(b) by 0 days.

(21) Appl. No.: 14/348,760

(22) PCT Filed: Mar. 25, 2013

(86) PCT No.: PCT/CA2013/000282

§ 371 (c)(1),
(2) Date: Mar. 31, 2014

(87) PCT Pub. No.: WO2013/138918

PCT Pub. Date: Sep. 26, 2013

(65) Prior Publication Data

US 2014/0246003 A1 Sep. 4, 2014

Related U.S. Application Data

(60) Provisional application No. 61/614,784, filed on Mar. 23, 2012.

(51) Int. Cl.

| | |
|---|---|
| ***F41B 5/12*** | (2006.01) |
| ***F41A 17/46*** | (2006.01) |
| ***F41A 19/10*** | (2006.01) |
| ***F41A 19/12*** | (2006.01) |
| ***F41A 19/17*** | (2006.01) |
| *F41A 19/42* | (2006.01) |

(52) U.S. Cl.
CPC . *F41B 5/12* (2013.01); *F41A 17/46* (2013.01); *F41A 19/10* (2013.01); *F41A 19/12* (2013.01); *F41A 19/17* (2013.01); *F41A 19/42* (2013.01)

(58) Field of Classification Search
CPC ..... F41B 5/12; F41B 5/1469
See application file for complete search history.

(56) References Cited

U.S. PATENT DOCUMENTS

| | | | | |
|---|---|---|---|---|
| 4,308,851 A | | 1/1982 | Kaine, Jr. et al. | |
| 4,567,875 A | * | 2/1986 | Fletcher | 124/35.2 |
| 4,877,008 A | * | 10/1989 | Troubridge | 124/25 |
| 5,170,771 A | * | 12/1992 | Peck | 124/35.2 |
| 5,299,374 A | | 4/1994 | Mathys | |

(Continued)

FOREIGN PATENT DOCUMENTS

| | | |
|---|---|---|
| EP | 0 166 877 A1 | 1/1986 |
| WO | 2005043068 A1 | 5/2005 |

*Primary Examiner* — John Ricci
(74) *Attorney, Agent, or Firm* — Tarolli, Sundheim, Covell & Tummino LLP

(57) ABSTRACT

A trigger assembly for activating a firing mechanism. The trigger assembly includes a trigger having a sear arm with a first sear surface, and a firing element including a body portion with a second sear surface and an engagement portion for engagement with the firing mechanism, for activating the firing mechanism. The trigger assembly also includes a captured roller positioned for engagement with the first and second sear surfaces. The trigger is pivotable between a load position, in which the captured roller is held between the first and second sear surfaces, and a release position, in which the second sear surface is disengaged from the captured roller and the firing element is released. The firing element is pivotable between a first position, in which the firing element is held by the captured roller, and a second position, in which the firing element is disengaged from the captured roller.

29 Claims, 23 Drawing Sheets

(56) References Cited

U.S. PATENT DOCUMENTS 5,370,102 A * 12/1994 Peck ..... 124/35.2
5,649,520 A * 7/1997 Bednar ..... 124/25
5,765,536 A * 6/1998 Scott ..... 124/35.2
6,763,819 B2 7/2004 Eckert

* cited by examiner

TRIGGER ASSEMBLY

CROSS-REFERENCE TO RELATED APPLICATION

This application claims the benefit of U.S. Provisional Patent Application No. 61/614,784, filed on Mar. 23, 2012, the disclosure of which is hereby incorporated fully herein by reference.

FIELD OF THE INVENTION

The present invention is a trigger assembly for activating a firing mechanism.

BACKGROUND OF THE INVENTION

Many known devices include a firing mechanism activatable by movement of a trigger. The devices are typically for firing or launching a projectile. Typically, the trigger is moved by imposing a trigger pull load on the trigger, to cause the trigger to move from a loaded position, at which the firing mechanism is activatable, to a released position, at which the firing mechanism is activated. Activation of the firing mechanism is conventionally effected in various ways, e.g., via release of an element of the firing mechanism, or otherwise initiating movement of an element of the firing mechanism. As is well known in the art, for various reasons, it is desirable that the trigger pull load be predictable, i.e., consistent for the user. For instance, the device can be more accurately aimed upon firing if the trigger pull load is consistent for the user. Also, in general, a trigger that requires a more consistent trigger pull load is more safely operated.

There are competing factors to be taken into account in determining the trigger pull load required to move the trigger. If the trigger pull load required is relatively large, then an inadvertent activation of the firing mechanism is unlikely. However, it is also desirable that the trigger pull load be relatively small, to make activating the firing mechanism relatively easy. This is generally thought to be desirable because it facilitates maintaining an accurate aim of the device when the trigger is pulled.

Those skilled in the art would be aware of various devices including firing mechanisms activatable by movement of a trigger. One example of a device including a firing mechanism activatable by a trigger is a crossbow, i.e., a high-powered weapon designed to shoot arrows (or bolts) at a target. As is well known in the art, the crossbow may include, for example, a stock with a bow mounted transversely on it. A bowstring across the bow is pulled taut, and the bolt is positioned to be propelled by the bowstring upon the bowstring's release. Typically, the taut bowstring is held in a cocked position by the firing mechanism, which is activatable by moving the trigger in a trigger mechanism to the released position thereof. However, the typical trigger mechanism has a number of deficiencies.

Typical draw forces for a crossbow vary from 100 to 250 lbs. As is well known in the art, it is desirable that such high loads should be dealt with by the trigger mechanism at relatively low trigger efforts (i.e., relatively low trigger pull loads), for shooting accuracy. However, known triggers rely on friction between the ticker (or trigger) and sear surfaces and as a result they have relatively high trigger pull efforts or loads, e.g., in the range of approximately 2.5 lbs. to approximately 9 lbs. (approximately 1.134 kg. to approximately 4.082 kg.).

In the prior art, to lower the coefficient of friction, certain techniques are employed (e.g., ticker and sear surfaces are polished, and/or lubrication is applied) in order to mitigate the relatively high trigger pull efforts. However, at best, the coefficient of friction is not lower than 0.1 in the conventional trigger mechanism. Even with those low values, however, the effort (load) required for trigger pull typically is not less than 2.5 lbs. (approximately 1.134 kg.).

Some manufacturers have attempted to use leverage (i.e., by changing the geometry of the conventional trigger mechanism) to lower forces between ticker and sear, but trigger effort still remains relatively high in the prior art. Also, in the prior art, the trigger pull effort can be inconsistent (i.e., unpredictable) due to wear of the polished surfaces, poor lubrication, or lack of lubricant.

As is well known in the art, similar issues concerning the desirability of decreasing the trigger pull effort and the predictability of the trigger pull effort required for activation of the firing mechanism are raised in connection with other devices including firing mechanisms that are activated by pulling the trigger, e.g., firearms.

SUMMARY OF THE INVENTION

For the foregoing reasons, there is a need for a trigger assembly that overcomes or mitigates one or more of the deficiencies of the prior art.

In its broad aspect, the invention provides a trigger assembly for activating a firing mechanism. The trigger assembly is mountable in a housing. The trigger assembly includes a trigger pivotally mounted on a trigger pivot pin, the trigger including an elongate trigger arm extending between a top end proximal to the trigger pivot pin and a bottom end distal to the trigger pivot pin and a sear arm positioned transverse to the trigger arm, the sear arm having a first sear surface. The trigger assembly also includes a firing element pivotally mounted on a firing element pivot pin, the firing element including a body portion having a second sear surface, and an engagement portion for engagement with at least a portion of the firing mechanism, for activating the firing mechanism. In addition, the trigger assembly includes a captured roller positioned for engagement with the first and second sear surfaces. The trigger is pivotable about the trigger pivot pin between a load position, in which the captured roller is held between the first and second sear surfaces, and a release position, in which the second sear surface is disengaged from the captured roller and the firing element is released. The firing element is pivotable about the firing element pivot pin between a first position, in which the firing element is held by the engagement of the second sear surface with the captured roller when the trigger is in the load position thereof and the firing mechanism is activatable by the engagement portion, and a second position, in which the firing element is disengaged from the captured roller and the firing mechanism is activated by the engagement portion, the firing element being movable to the second position upon the trigger moving to the release position thereof.

In another aspect, the captured roller is elongate and at least partially defines a central axis thereof. The captured roller is mounted in the housing for rotation of the captured roller about the central axis and for movement of the captured roller substantially transverse to the central axis as the trigger moves from the load position to the release position to provide substantially consistent frictional resistance to movement of the first and second sear surfaces relative to each other. In particular, the captured roller provides rolling frictional resistance to movement of the first and second sear surfaces relative to each other.

In another aspect, the first and second sear surfaces cooperate to permit the trigger to be movable from the load position toward the release position upon application of a first trigger pull load on the trigger until the trigger reaches a transition position, and the first and second sear surfaces cooperate to permit the trigger to be movable from the transition position toward the release position upon application of a second trigger pull load on the trigger.

In yet another aspect, the second trigger pull load exceeds the first trigger pull load, to hinder or impede activation of the firing mechanism.

In another of its aspects, the invention provides a trigger assembly for mounting in a housing in a crossbow, the housing having an opening at a forward side thereof in which a bowstring is at least partially positionable in a drawn position thereof. The trigger assembly includes a trigger pivotally mounted on a trigger pivot pin supported in the housing. The trigger includes an elongate trigger arm extending between a top end proximal to the trigger pivot pin and a bottom end distal thereto, and a sear arm positioned transverse to the trigger arm, the sear arm having a first sear surface. The trigger assembly also includes a firing element pivotally mounted on a firing element pivot pin supported in the housing. The firing element includes a body portion having a second sear surface and a hook portion. In addition, the trigger assembly includes a captured roller positioned for engagement with the first and second sear surfaces. The trigger is pivotable about the trigger pivot pin between a load position, in which the captured roller is held between the first and second sear surfaces, and a release position, in which the second sear surface is disengaged from the captured roller and the firing element is released. The firing element is pivotable about the firing element pivot pin between a hooked position and an open position. In the hooked position, the firing element is held by the engagement of the second sear surface with the captured roller when the trigger is in the load position thereof and the firing mechanism is activatable by the engagement portion, the bowstring being retainable by the hook portion when the firing element is in the hooked position. In the open position the firing element is disengaged from the captured roller and the bowstring is releasable from the firing element, the firing element being movable to the open position upon the trigger moving to the release position thereof.

In another aspect, the captured roller is elongate and at least partially defines a central axis thereof. The captured roller is mounted in the housing for rotation of the captured roller about the central axis and for movement of the captured roller in at least one direction substantially transverse to the central axis as the trigger moves from the load position to the release position to provide substantially consistent frictional resistance to movement of the first and second sear surfaces relative to each other.

BRIEF DESCRIPTION OF THE DRAWINGS

The invention will be better understood with reference to the attached drawings, in which.

DETAILED DESCRIPTION

Figure 1A:
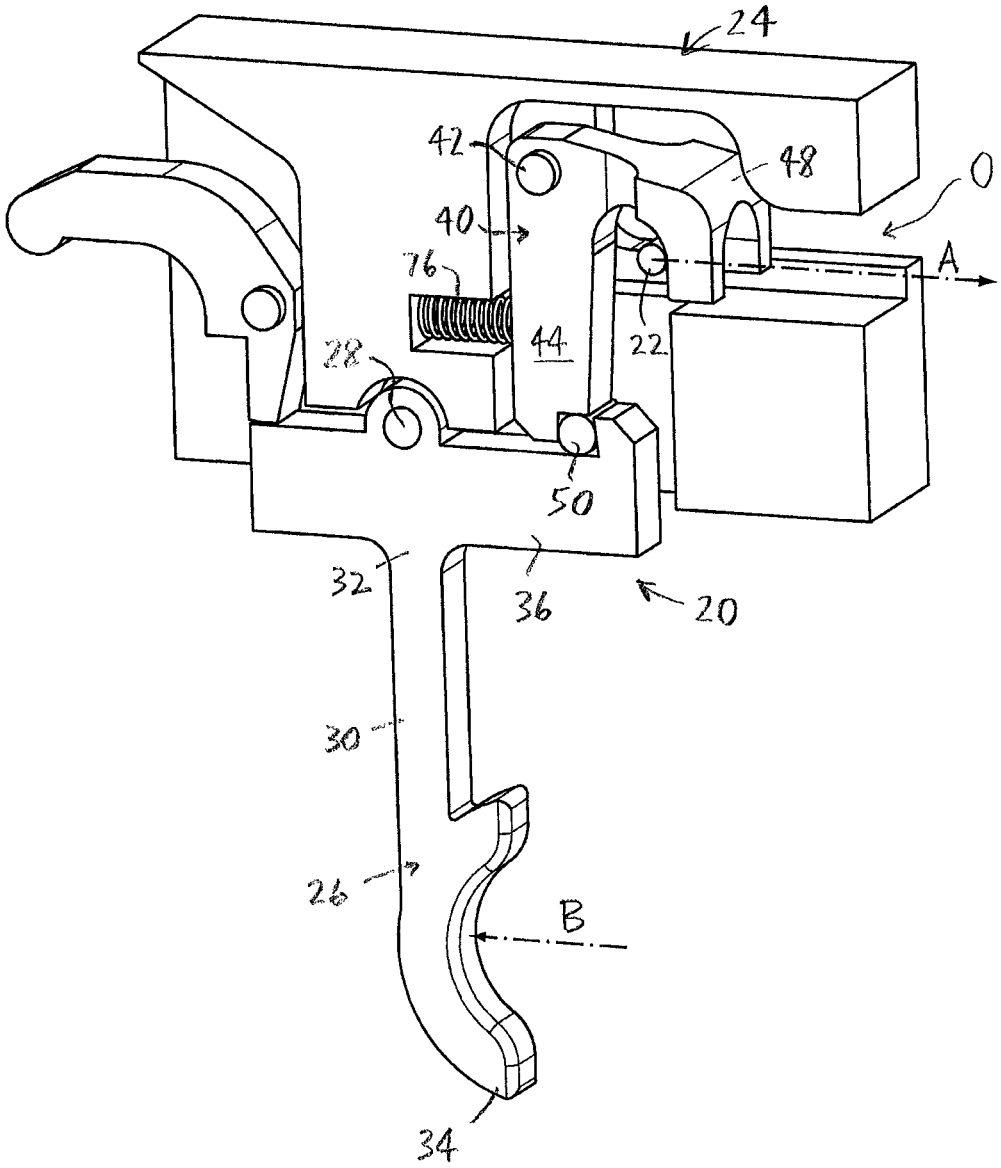
FIG. 1A is an isometric view of an embodiment of a trigger assembly of the invention.

In the attached drawings, like reference numerals designate corresponding elements throughout. Reference is first made to FIGS. 1A-11 to describe an embodiment of a trigger assembly of the invention referred to generally by the reference numeral 20. As will be described, the trigger assembly 20 is for activating a firing mechanism 22. Preferably, the trigger assembly 20 is mountable in a housing 24. In one embodiment, the trigger assembly 20 preferably includes a trigger 26 pivotally mounted on a trigger pivot pin 28. It is preferred that the trigger 26 includes an elongate trigger arm 30 extending between a top end 32 proximal to the trigger pivot pin 28, and a bottom end 34 distal to the trigger pivot pin 28. The trigger 26 preferably also includes a sear arm 36 positioned transverse to the trigger arm 30, the sear arm 36 having a first sear surface 38 (FIGS. 3, 8). As can be seen in FIGS. 1A and 2-7B, the trigger assembly 20 preferably also includes a firing element 40 pivotally mounted on a firing element pivot pin 42. In one embodiment, the firing element 40 preferably includes a body portion 44 with a second sear surface 46 (FIGS. 3, 8), and an engagement portion 48 for engagement with at least a portion of the firing mechanism 22, for activating the firing mechanism 22. It is also preferred that the trigger assembly 20 includes a captured roller 50 positioned for engagement with the first and second sear surfaces 38, 46, as will also be described. Preferably, the trigger 26 is pivotable about the trigger pivot pin 28 between a load position (FIGS. 1A, 2), in which the captured roller 50 is held between the first and second sear surfaces 38, 46, and a release position (FIG. 7B), in which the second sear surface 46 is disengaged from the captured roller 50 and the firing element 40 is released. It is also preferred that the firing element 40 is pivotable about the firing element pivot pin 42 between a first position (FIGS. 1A, 2), in which the firing element 40 is held by the engagement of the second sear surface 46 with the captured roller 50 when the trigger 26 is in the load position thereof and the firing mechanism 22 is activatable by the engagement portion 48, and a second position (FIG. 7B), in which the firing element 40 is disengaged from the captured roller 50 and the firing mechanism 22 is activated by the engagement portion 48, the firing element 40 being movable to the second position upon the trigger 26 moving to the release position thereof.

Figure 1B:
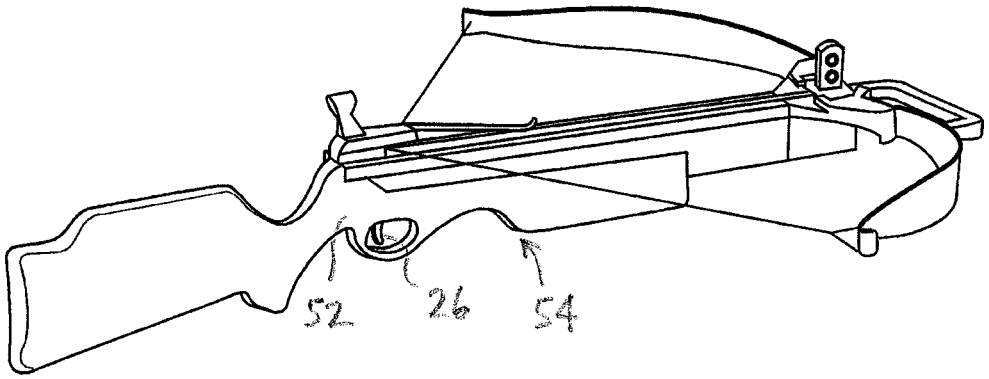
FIG. 1B is an isometric view of an embodiment of a crossbow including the trigger assembly of the invention, drawn at a smaller scale.

It will be understood that the housing 24 is only partially illustrated in FIGS. 1A, 1D, and 2-7B, for clarity of illustration. Those skilled in the art would be aware that the housing 24 is designed to support the trigger assembly 20 in a body 52 of a device 54 (FIG. 1B). As will be described, the device 54 preferably is for firing or launching a projectile. Those skilled in the art would also be aware that the device in which the trigger assembly of the invention and the firing mechanism activated thereby are mounted may be one of various devices. As illustrated in FIG. 1B, for example, in one embodiment, the device 54 may be a crossbow. In FIGS. 1A and 2-7B, the bowstring 56 is the only part of the device's firing mechanism 22 that is shown. The balance of the device's firing mechanism is omitted from FIGS. 1A and 2-7B for clarity of illustration. In one embodiment, it is preferred that the trigger assembly 20 is mounted in the housing 24 in the crossbow 54. The housing 24 has an opening "O" at a forward side thereof in which the bowstring 56 is at least partially positionable in a drawn position thereof, as shown in FIG. 1A.

As is well known in the art, the activation of the firing mechanism may be achieved in various ways, depending on the firing mechanism. For instance, in some conventional firing mechanisms, the trigger assembly 20 activates the firing mechanism by releasing an element of the firing mechanism. An example of this is illustrated in FIGS. 2-7B, in which a bowstring is a part of the firing mechanism of the crossbow, and the firing mechanism of the crossbow is activated when the bowstring is released by the trigger assembly, as will be described.

Additional examples are provided by the conventional firing mechanisms of firearms. As is well known in the art, such firing mechanisms may be activated by release of an element of the firing mechanism, or they may alternatively be activated by striking or otherwise pushing or pulling an element of the firing mechanism. For example, the firing mechanism may include a firing pin, and the firing mechanism may be activated by an element of the trigger assembly striking an element of the firing mechanism. For example, in FIGS. 13D and 14D, a hammer in embodiments of the trigger assembly of the invention activates the firing mechanism of a firearm by striking a firing pin thereof.

Figure 2:
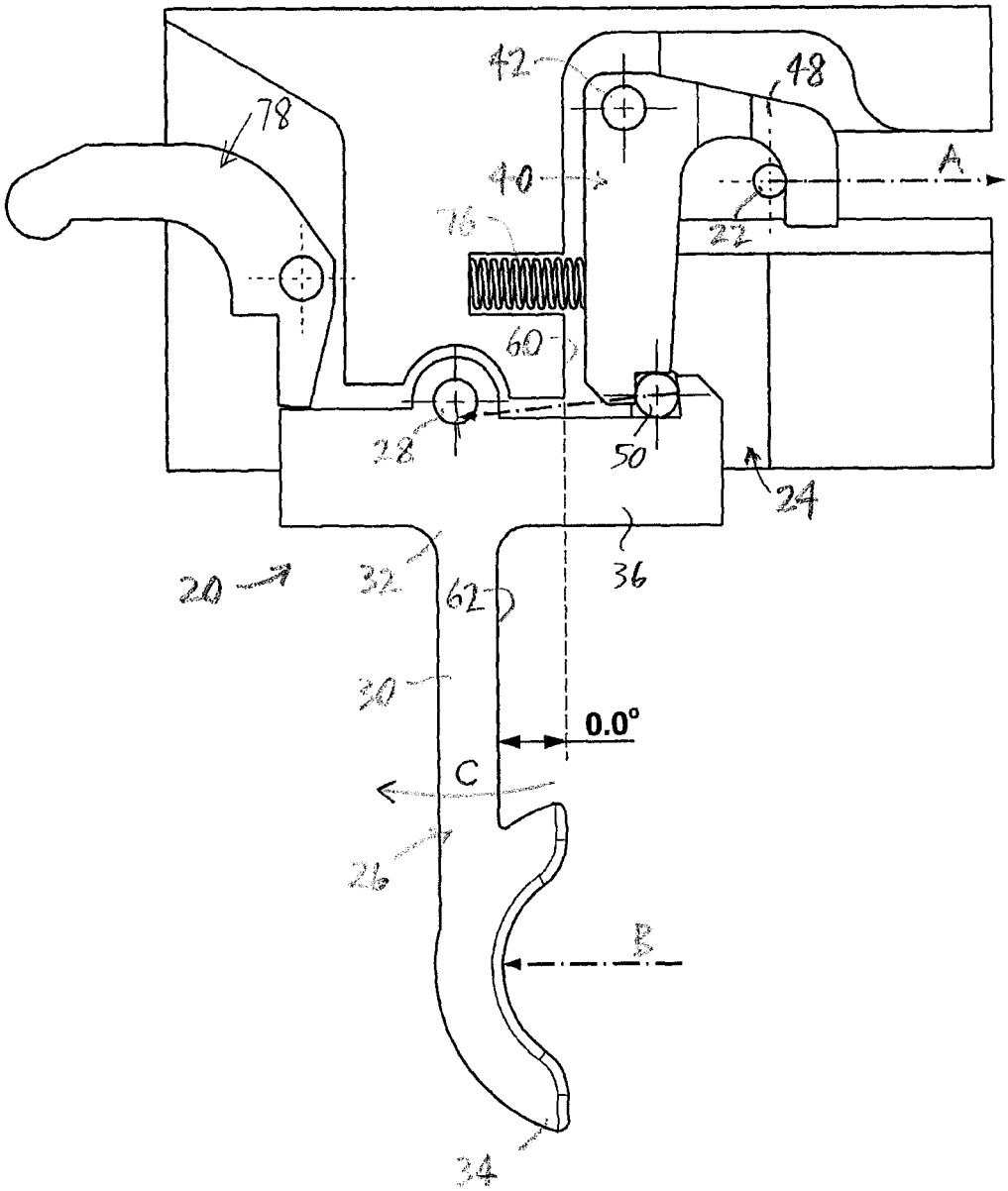
FIG. 2 is a side view of the trigger assembly of FIG. 1A, in which a trigger is in a loaded position, and a catch is in a hooked position retaining a bowstring, drawn at a smaller scale.
Figure 3:
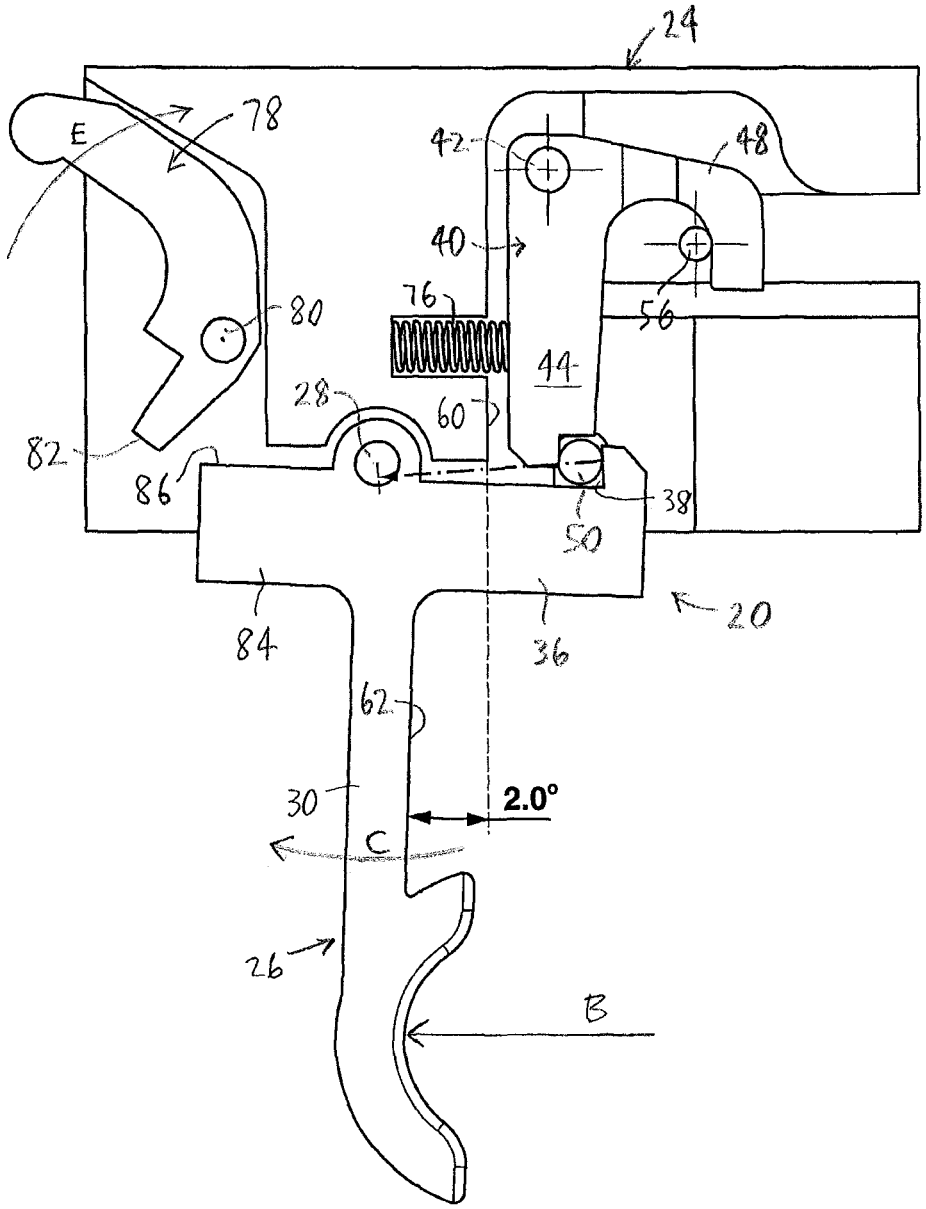
FIG. 3 is a side view of the trigger assembly of FIG. 1A, in which a safety element is disengaged from the trigger, permitting the trigger to move toward a released position.
Figure 4:
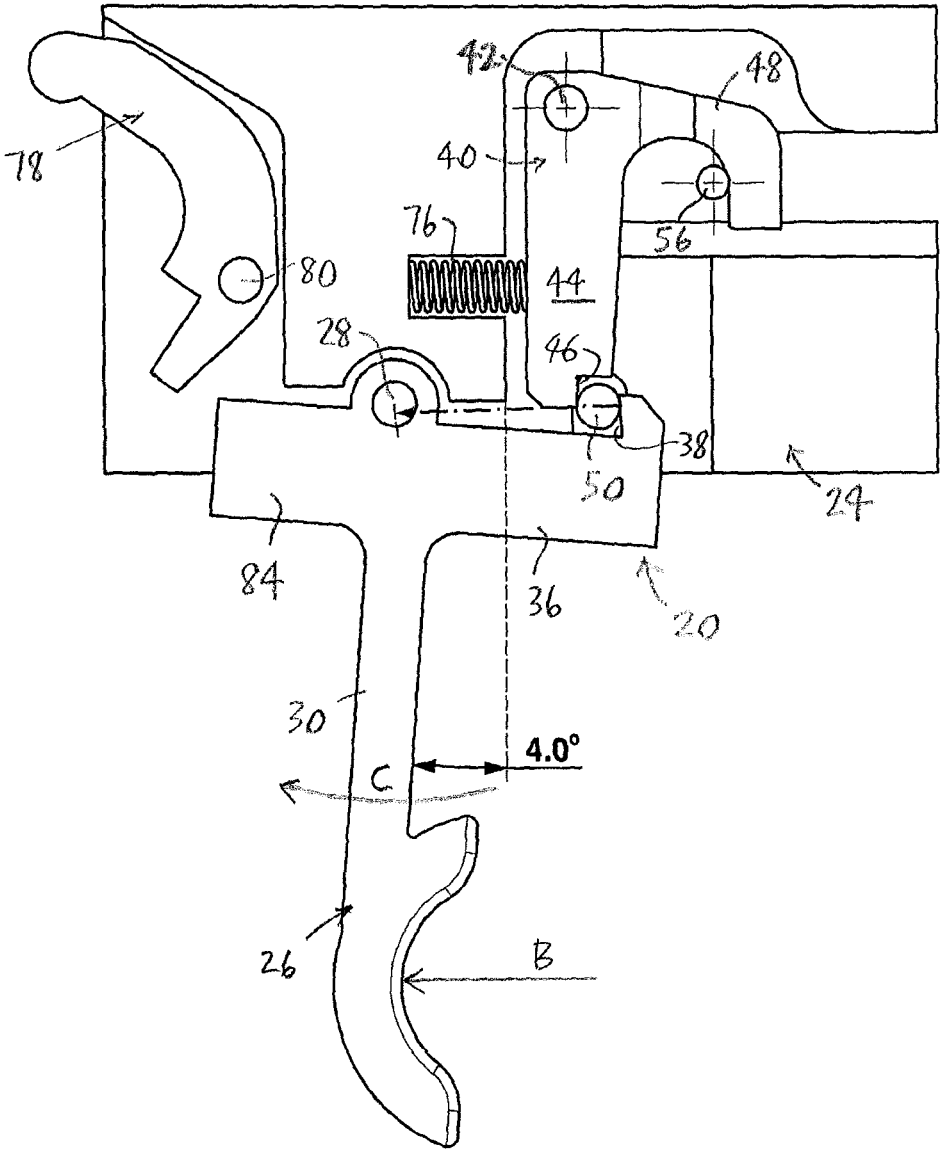
FIG. 4 is a side view of the trigger assembly of FIG. 1A, in which the trigger is moved further toward the released position.
Figure 5:
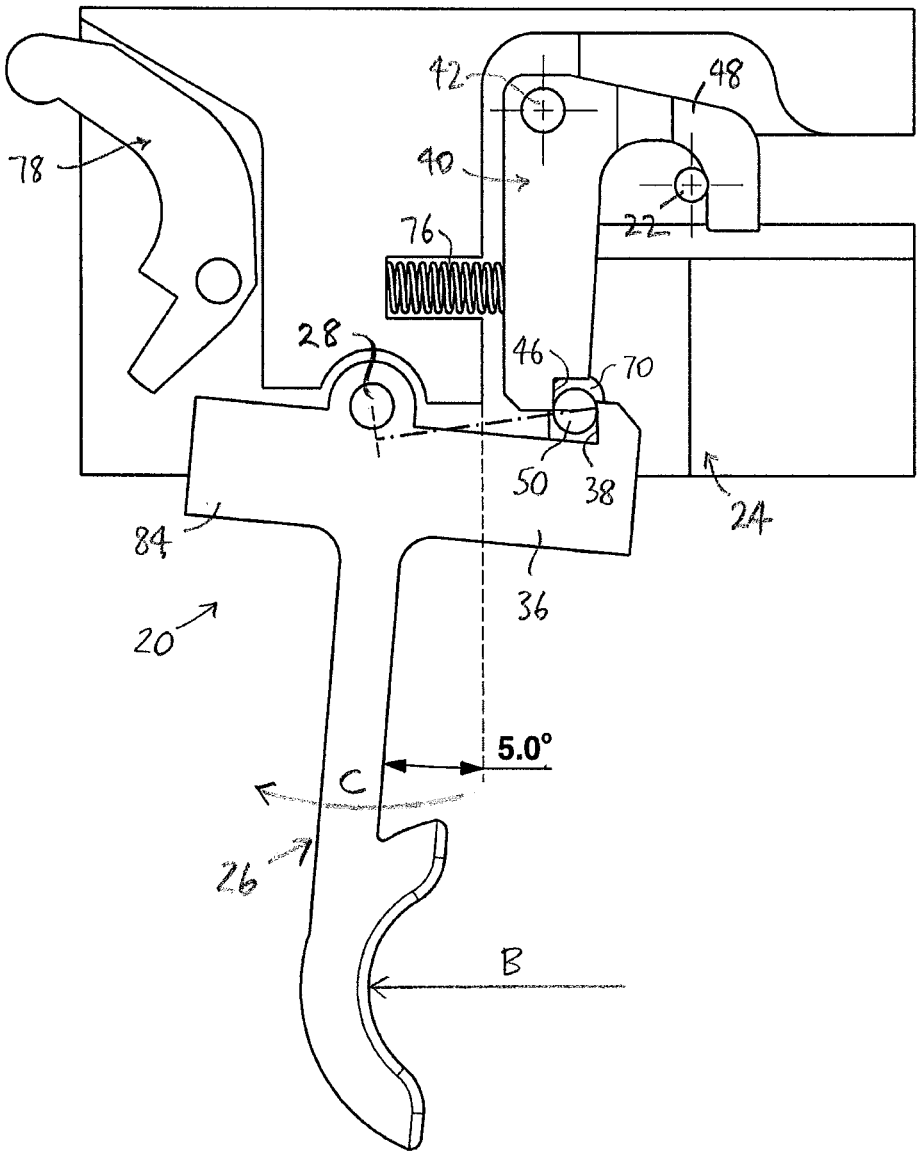
FIG. 5 is a side view of the trigger assembly of FIG. 1A, in which the trigger is moved further toward the released position.

As can be seen in FIGS. 1A and 2, when the crossbow 54 is loaded, a bowstring 56 is urged in the direction indicated by arrow "A", due to the energy stored in the bowstring 56. The bowstring 56 preferably is restrained by the firing element 40, when the firing element 40 is in the first position. Also, and as shown in FIGS. 1A and 2, when a user (not shown) wishes to release the bowstring (i.e., to launch the projectile (a bolt (not shown)) engaged endwise with the bowstring 56), the user exerts pressure on the trigger 26 as indicated by arrow "B", i.e., the user imposes at least a trigger pull load on the trigger 26. For example, the user may impose the trigger pull load on the trigger via an index finger. The user moves the trigger 26 from the load position (FIGS. 1A and 2) to the release position (FIG. 7B) by rotating the trigger 26 through a relatively small arc 58 (FIG. 7B) centered on the trigger pivot pin 28, by maintaining at least the trigger pull load against or on the trigger 26 in the direction indicated by arrow "B". When the trigger 26 has moved through the entire arc 58, it reaches the release position (FIG. 7B). As will be described, once the trigger 26 reaches the release position, the firing element 40 is virtually instantaneously moved to its second position.

Referring to FIGS. 2-7B, it can be seen that the firing element is pivotable about the firing element pivot pin between the first position (or the hooked position) and the second position (or the open position). When the firing element is in the hooked position (FIGS. 1A and 2-7A), the firing element is held by the engagement of the second sear surface with the captured roller when the trigger is in the load position thereof, and the firing mechanism is activatable by the engagement portion of the firing element. The bowstring 56 is retainable by the engagement (or hook) portion 48 when the firing element is in the hooked position, as can be seen in FIGS. 1A and 2-7A. When the firing element is in the open position (FIG. 7B), the firing element is disengaged from the captured roller and the bowstring is releasable from or by the firing element. The firing element moves to the open position upon the trigger moving to the release position thereof.

The invention herein reduces the trigger pull load (i.e., the load required to be imposed on the trigger in the direction indicated by arrow "B" in FIGS. 1A and 2 to move the trigger 26 from the load position to the release position), as compared to the trigger pull effort required with conventional trigger mechanisms. This is achieved by utilizing a structure in which frictional resistance is reduced. In one embodiment, the trigger assembly 20 preferably also provides a consistent resistance to the movement of the trigger 26 from the load position to the release position. Accordingly, the trigger assembly 20 enables the user to maintain the device in position so that it is accurately aimed when the trigger is pulled.

Preferably, the trigger pivot pin 28 is supported in the housing 24. In FIG. 2, a substantially planar reference surface 60 on the housing 24 is identified. For illustrative clarity, the reference surface 60 is formed and positioned so that, when the trigger 26 is in the loaded position, the surface 60 is substantially parallel with a front surface 62 of the trigger 26. At this point, as can be seen in FIG. 2, the trigger rotation is 0°, i.e., the front surface 62 of the trigger 26 is parallel with the reference surface 60.

As can be seen in FIGS. 2-7B, to move the trigger 26 from the load position (FIGS. 1A, 2) to the release position (FIG. 7B), the trigger 26 is rotated about the trigger pivot pin 28 through the arc 58, i.e., in the direction indicated by arrow "C" in FIGS. 2-7A. As illustrated in FIGS. 2-7B, the trigger 26 is moved from the load position (FIG. 2), in which the captured roller 50 is held between the first and second sear surfaces 38, 46, to the release position (FIG. 7B), in which the second sear surface 46 is disengaged from the captured roller 50.

Figure 7A:
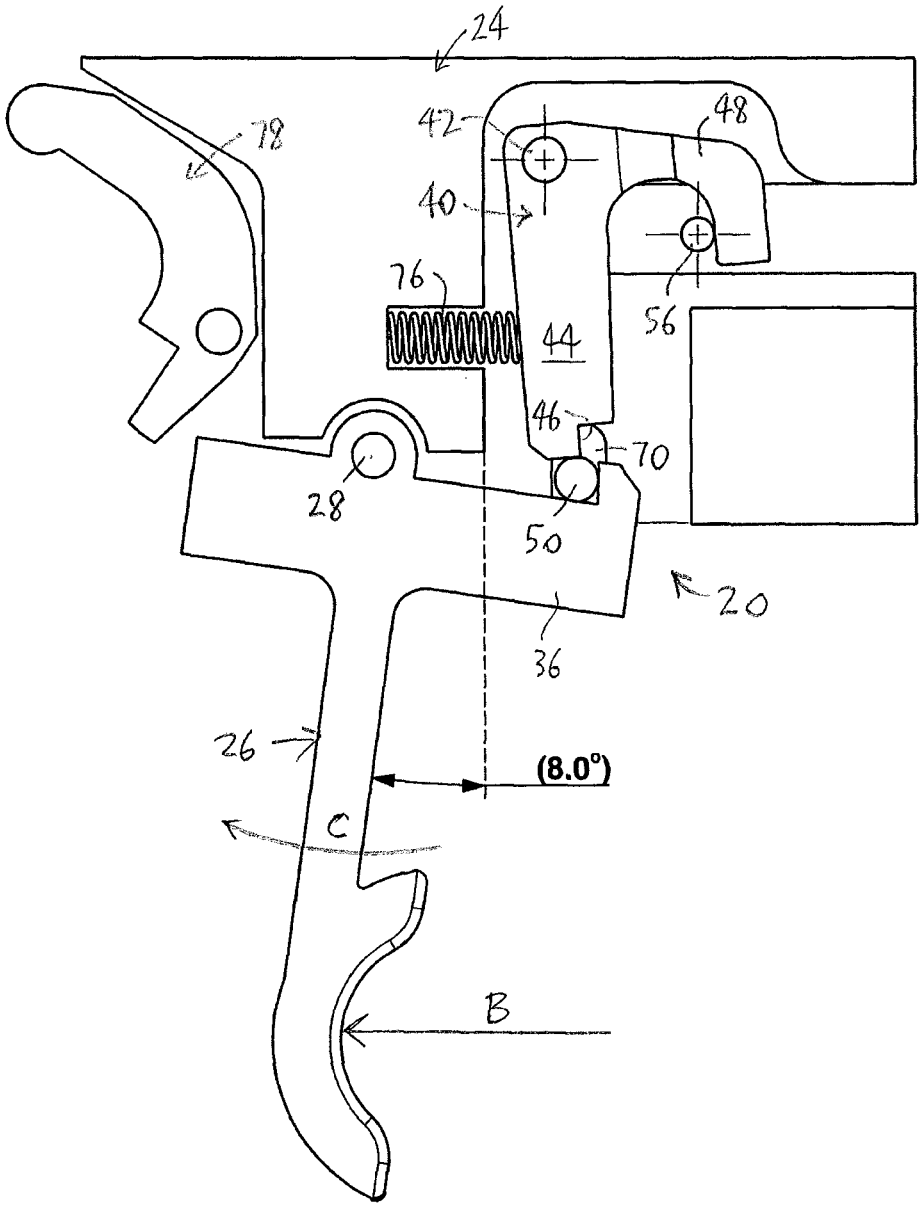
FIG. 7A is a side view of the trigger assembly of FIG. 1A, in which the trigger is in the released position and the catch is in the open position.
Figure 7B:
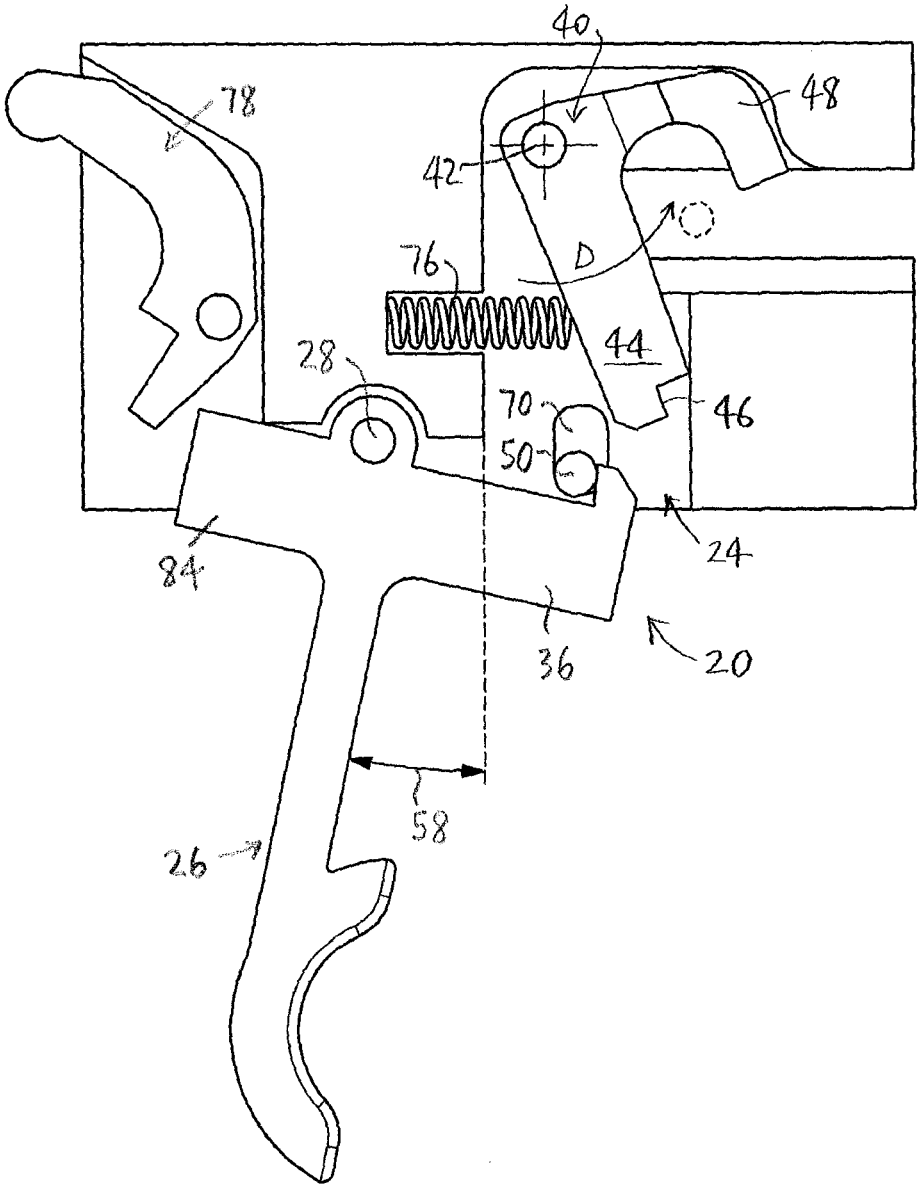
FIG. 7B is a side view of the trigger assembly of FIG. 1A, in which the trigger is in the released position and the catch is in the open position.
Figure 8:
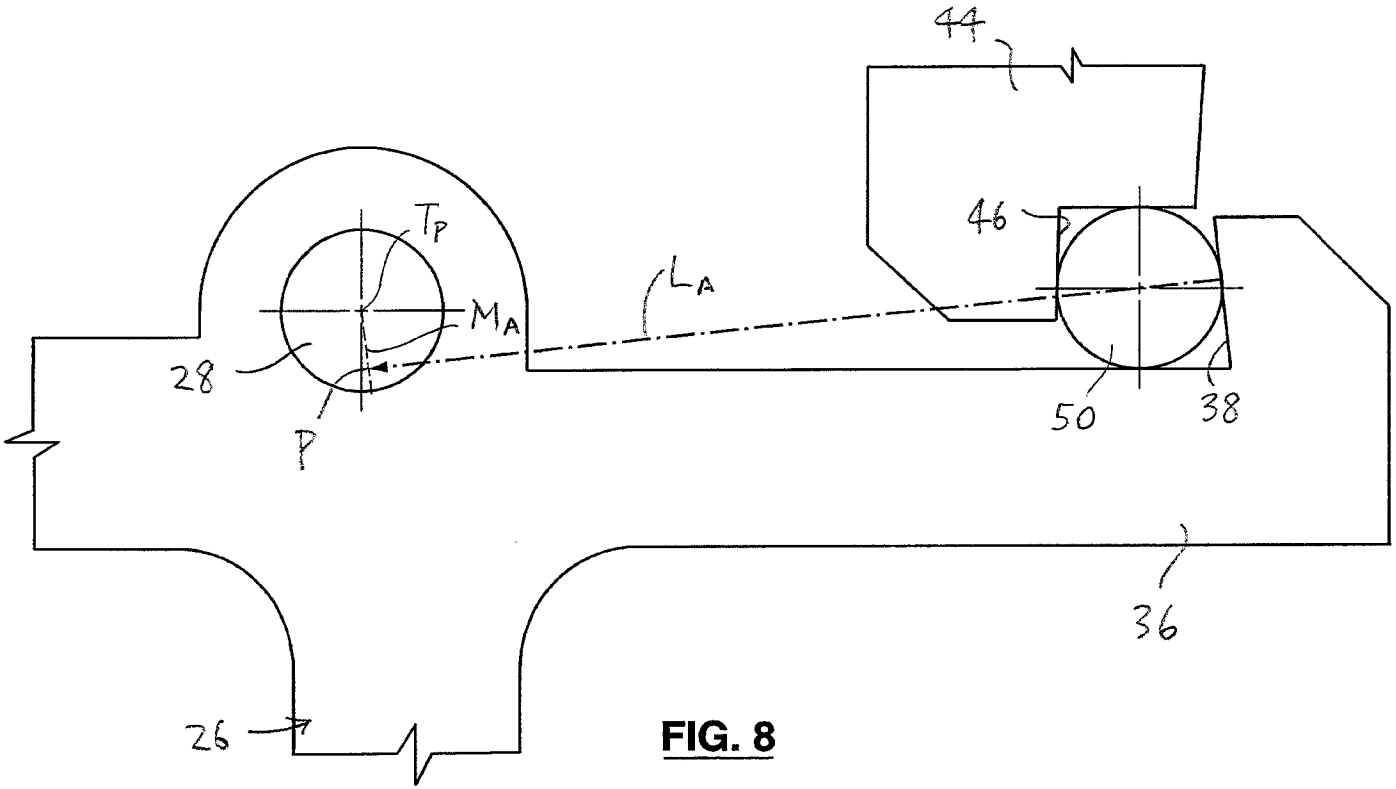
FIG. 8 is a side view of a portion of an embodiment of a trigger assembly of the invention, drawn at a larger scale.

As can be seen in FIGS. 7A and 7B, it is preferred that the first sear surface 38 remains engaged with the captured roller 50 while the trigger 26 moves through the arc 58, and also when the trigger 26 is in the release position. For instance, as shown in FIG. 3, when the trigger 26 has rotated approximately 2° in the direction indicated by arrow "C", the sear arm 36 is pivoted downwardly relative to the body portion 44 (i.e., also in the direction indicated by arrow "C") to a corresponding extent. The progressive rotational movement of the trigger 26 through the arc 58, i.e., generally from the load position to the release position, can be seen in FIGS. 4 (approximately 4°), 5 (approximately 5°), 6 (approximately 6°), and 7A (approximately 8°).

Figure 1C:
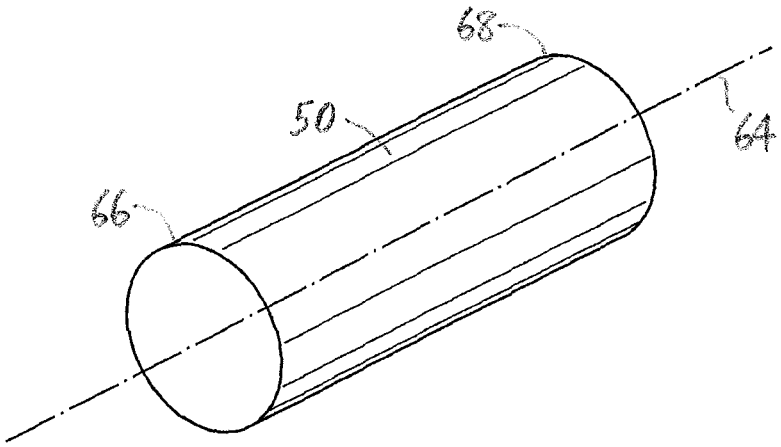
FIG. 1C is an isometric view of an embodiment of a roller of the invention, drawn at a larger scale.

As can be seen in FIG. 1C, in one embodiment, the captured roller 50 preferably is elongate and at least partially defines a central axis 64 thereof. Preferably, the captured roller 50 is mounted in the housing 24 for rotation of the captured roller 50 about the central axis 64 and for movement of the captured roller 50 substantially transverse to the central axis 64 as the trigger 26 moves from the load position to the release position to provide substantially consistent frictional resistance to movement of the first and second sear surfaces 38, 46 relative to each other. In particular, the captured roller provides rolling frictional resistance to movement of the first and second sear surfaces relative to each other.

Figure 1D:
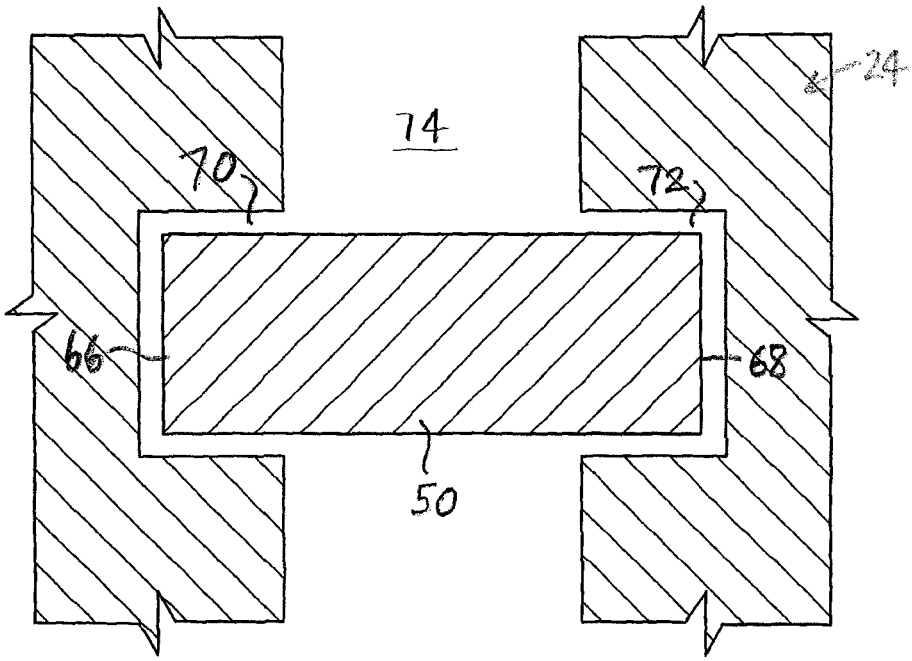
FIG. 1D is a cross-section of an embodiment of a housing of the invention showing the roller of FIG. 1C captured in a slot in the housing, drawn at a larger scale.

It is also preferred that the captured roller 50 is substantially in the form of a right cylinder, and extends between ends 66, 68 thereof. As can be seen in FIG. 1D, the captured roller 50 preferably is positioned in the housing 24 with its ends 66, 68 located in apertures 70, 72 on each side of a slot 74 formed in the housing 24. Those skilled in the art will appreciate that the captured roller 50 preferably is retained relatively loosely in the apertures 70, 72 to permit the captured roller 50 to rotate, and also to move substantially transversely to the central axis 64, as will be described. Because of this, the frictional resistance to movement of the first and second sear surfaces relative to each other is at least primarily rolling frictional resistance, i.e., because the roller 50 rotates about its central axis. However, because the roller is also movable in the apertures 70, 72 in directions substantially transverse to the central axis 64, the roller 50 is also movable to accommodate the movement of the first and second sear surfaces relative to each other as the trigger is pulled. It will be understood that a number of elements are omitted from FIG. 1D for clarity of illustration.

Those skilled in the art would appreciate that the apertures 70, 72 preferably are somewhat elongate. For example, as show in FIG. 7B, the aperture 70 preferably has an oblong outline, to permit substantial movement of the captured roller 50 in directions that are substantially transverse to the central axis 64 of the captured roller 50. Accordingly, the captured roller 50 is at least partially positioned in the pair of apertures 70, 72 formed in the housing 24, to permit limited transverse movement of the captured roller 50, i.e., movement transverse to the central axis 64.

In one embodiment, the firing element 40 preferably is biased to the second position. It is preferred that the trigger assembly 20 also includes a biasing element 76 supported in the housing 24 and engaged to the firing element 40, for biasing the firing element 40 to the second position thereof. Preferably, the biasing element 76 is positioned to urge the firing element 40 to rotate about the firing element pivot pin 42 substantially in the direction indicated by arrow "D" in FIG. 7B. Those skilled in the art would be aware of suitable biasing elements. In one embodiment, the biasing means 76 preferably is a compression spring, as shown in FIGS. 1A and 2-7B.

As can be seen in FIG. 7B, once the second sear surface 46 is disengaged from the captured roller 50, the body portion 44 is free to pivot about the firing element pivot pin 42 in the direction indicated by arrow "D", resulting in corresponding rotational movement of the engagement portion 48. As illustrated in FIG. 7B, when the engagement portion (or hook portion) 48 pivots sufficiently far in the direction indicated by arrow "D", the bowstring 56 is released, and a bolt (not shown) is launched, propelled by the energy that has been stored in the bowstring 56. Those skilled in the art would appreciate that the movement of the released bowstring 56 is in the direction indicated by arrow "A" in FIG. 7B, and the bolt is launched in the direction indicated by arrow "A".

Devices typically include safety catches, to prevent inadvertent discharge. In one embodiment, the trigger assembly 20 preferably also includes a safety element 78 pivotally mounted about a safety element pivot pin 80. Preferably, the safety element 78 includes a safety element engagement surface 82 (FIG. 3). Also, and as can be seen in FIGS. 1A and 2, it is preferred that the trigger 26 additionally includes a safety arm 84 extending substantially transversely relative to the trigger arm 30, the safety arm 84 having a safety arm engagement surface 86 (FIG. 3). As can also be seen in FIGS. 1A and 2, when the trigger 26 is in the loaded position, the safety element 78 preferably is positioned for engagement of the safety element engagement surface 82 and the safety arm engagement surface 86, to lock the trigger 26 in the load position.

INDUSTRIAL APPLICABILITY

In use, when the trigger 26 is in the load position and the user wishes to release the bowstring 56, the safety element 78 is first released by the user. As can be seen in FIG. 3, to release the safety element 78, the safety element 78 is pivoted about the safety element pivot pin 80 in the direction indicated by arrow "E" in FIG. 3. This pivoting movement disengages the safety element engagement surface 82 from the safety arm engagement surface 86. Due to such disengagement, the trigger 26 is permitted to rotate in the direction indicated by arrow "C" about the trigger pivot pin 28 (FIG. 3).

It can be seen from FIGS. 2-7B that, after the safety element 78 has been released, when the user presses the trigger arm 30 in the direction indicated by arrow "B", the trigger 26 pivots about the trigger pivot point 28 in the direction indicated by arrow "C" (FIG. 2).

As can be seen in FIGS. 3-7B, the captured roller 50 remains engaged with the first sear surface 38 as the first sear surface 38 is pivoted generally downwardly (i.e., in the direction indicated by arrow "C" in FIG. 7A) relative to the body portion 44 as the trigger 26 is pivoted in the direction indicated by arrow "E" about the trigger pivot point 28. As can be seen in FIGS. 3-7B, ultimately, the second sear surface 46 is disengaged from the captured roller 50, and the firing element 40, urged to do so by the resilient element 76, pivots about the catch pivot point 46 in the direction indicated by arrow "D". Due to the engagement portion 48 pivoting sufficiently upwardly, the bowstring 56 is released at this point.

It will be understood that the firing element 40 moves to the second position thereof substantially immediately upon the firing element 40 disengaging from the captured roller 50.

From the foregoing, it can be seen that, as the trigger 26 is moved from the load position to the release position, each of the first and second sear surfaces 38, 46 engages the captured roller 50, and together the first and second sear surfaces 38, 46 cause the captured roller 50 to rotate about the central axis 64 thereof, and also cause the captured roller to move transversely relative to the central axis 64. Accordingly, and as shown in FIGS. 2A-7B, the engagement of the first and second sear surfaces 38, 46 with the captured roller 50 involves rolling friction. When the trigger 26 is pressed, the sear arm 36 pivots downwardly (i.e., in a clockwise direction, as shown in FIGS. 2-7B) while the body portion 44 remains substantially stationary relative to the housing 24, causing the captured roller 50 to rotate about its central axis 64 in the clockwise direction (as shown in the drawings).

Accordingly, because the trigger assembly 20 of the invention includes the captured roller 50 held between the first and second sear surfaces 38, 46, the first and second sear surfaces 38, 46 do not engage each other, i.e., they do not slide against each other, unlike trigger mechanisms of the prior art. Instead, they engage the captured roller, resulting in significantly less frictional resistance to movement of the trigger 26 from the load position to the release position, as compared to the frictional resistance encountered in conventional trigger mechanisms.

Those skilled in the art would appreciate that the movement of the captured roller 50 relative to the first and second sear surfaces 38, 46 due to the trigger 26 being pulled tends to be consistent every time the trigger is pulled, due to the relatively low rolling friction, resulting in the captured roller 50 and the first and second sear surfaces 28, 46 being subjected to less wear than the sear surfaces in sliding engagement, in conventional trigger mechanisms.

It has been determined that, in the trigger assembly 20 of the invention, the amount of pull required (i.e., the load required to be directed onto the trigger 30) is relatively small. This is because, as described above, the trigger assembly 20 of the invention involves rolling friction, not sliding friction. It has also been determined that changes in the first and second sear surfaces 38, 46 can materially affect the relevant characteristics of the trigger assembly 20, as will be described.

It will be understood that the details of the arc 58 (i.e., the position of the trigger 26 relative to the reference surface 60) as shown in FIGS. 2-7B are dependent on the specific configurations of the parts of the trigger assembly 20. In particular, the measurements of the position of the trigger on the arc 58 as provided in FIG. 11 (i.e., along the x axis thereof) are representative and exemplary only, and are not based on the trigger assembly 20 as illustrated in FIGS. 1A and 2-7B, which is not drawn to scale.

Figure 11:
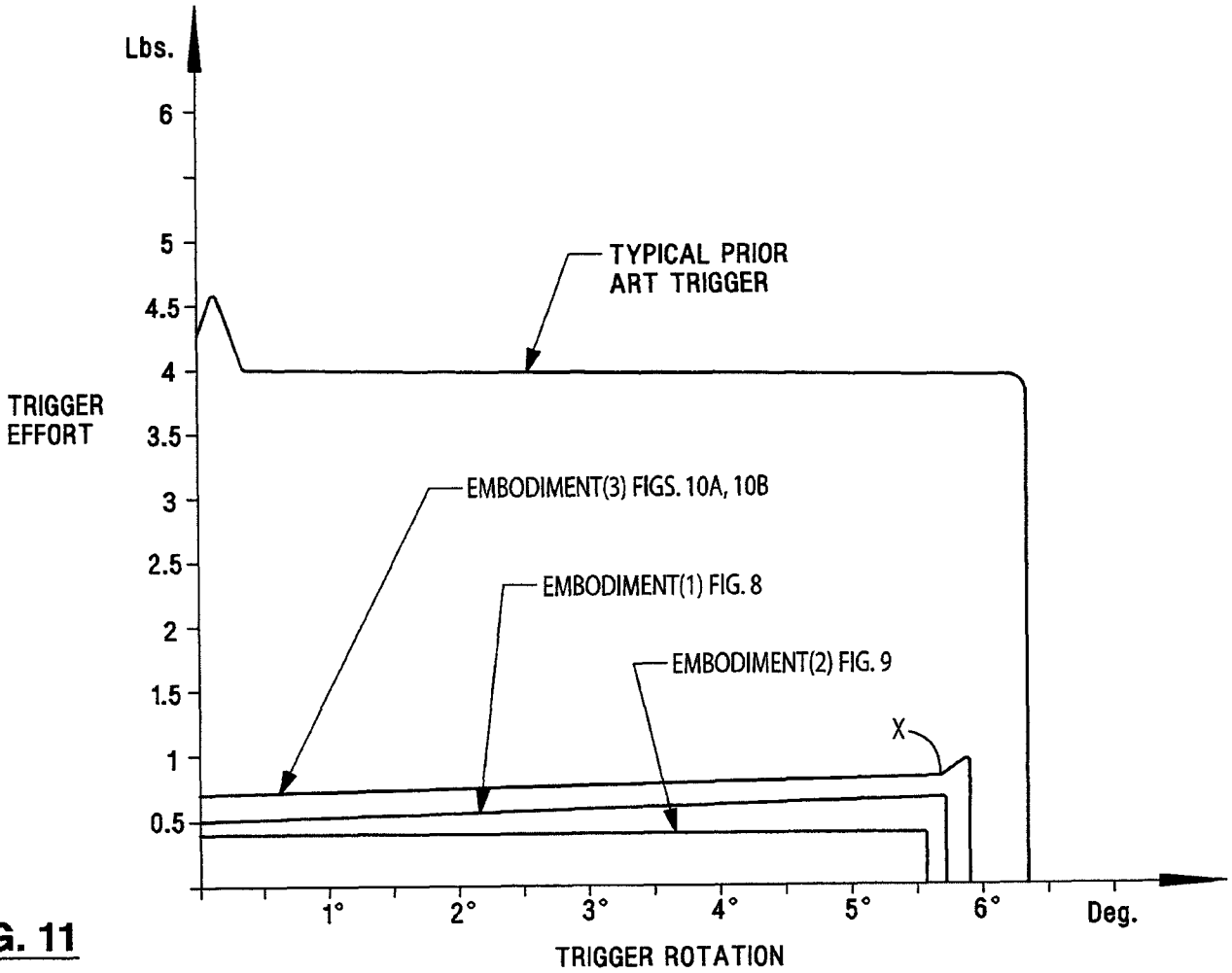
FIG. 11 is a graphic representation showing trigger effort as a function of trigger rotation, for a variety of trigger assemblies.

In one embodiment, the first and second sear surfaces 38, 46 are at least partially planar (FIG. 8). As can be seen in FIG. 11, in this embodiment (identified in FIG. 11 as "Embodiment (1)"), the trigger pull load required to move the trigger through the arc 58 is relatively modest, and gradually increases until the bowstring is released. As illustrated in FIG. 11, compared to the load required to release the bowstring in the typical prior art trigger, far less load (i.e., far less pressure on the trigger) is needed in this embodiment to achieve release.

As can be seen in FIG. 8, when the trigger is squeezed, a moment of force is generated, with a line of action ("$L_A$") directed to a point "P" offset from the trigger arm pivot point "$T_P$" by a moment arm "$M_A$". Due to this, the pressure exerted on the trigger 26 gradually increases as the trigger moves from the loaded position to the released position.

Figure 6:
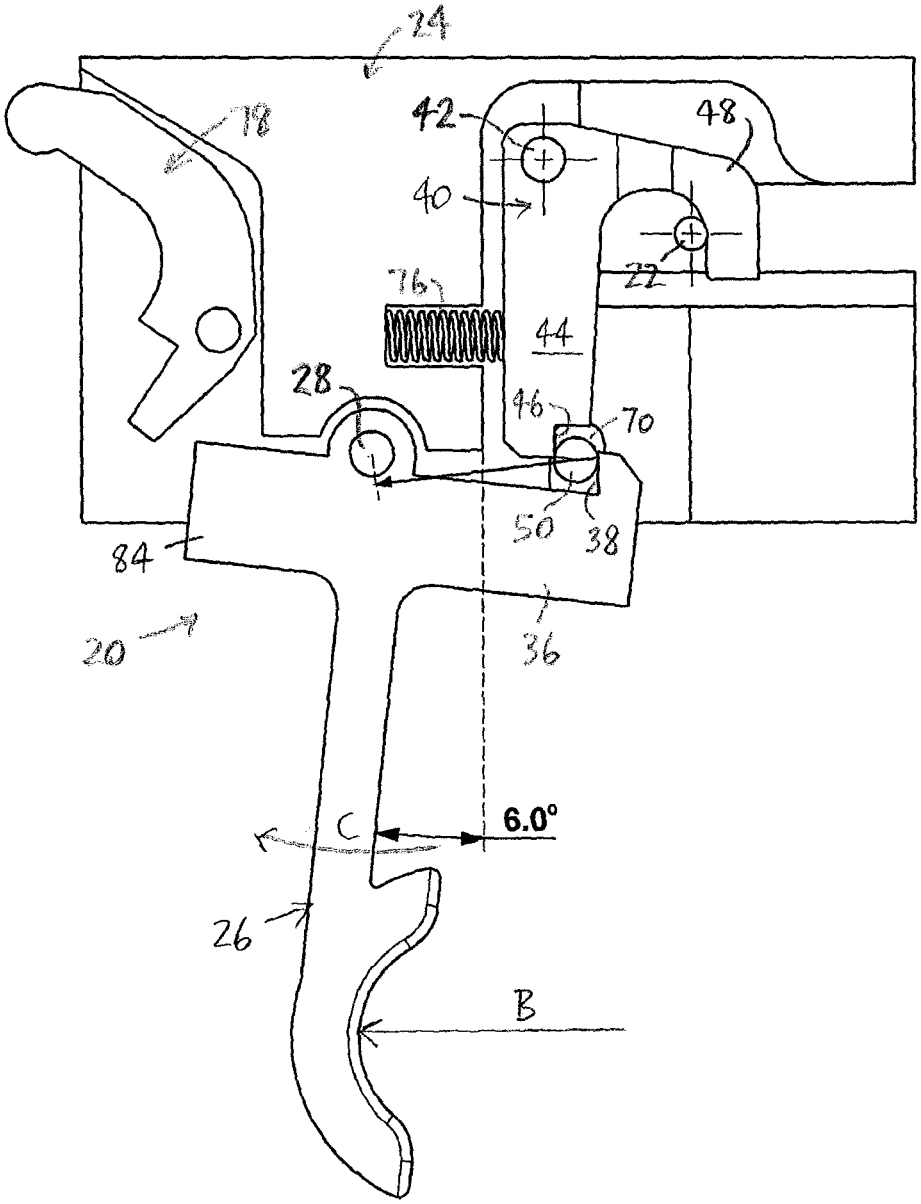
FIG. 6 is a side view of the trigger assembly of FIG. 1A, in which the trigger is in the released position and the catch is in the open position.

As can be seen, e.g., in FIG. 6, as the trigger 26 is pulled from the load position to the release position, the first sear surface is moved downwardly (as illustrated in FIGS. 1A, 2-7B, and 8-10B) relative to the second sear surface and the captured roller 50.

Because the captured roller 50 is held between the first and second sear surfaces, the downward movement of the first sear surface results in the first sear surface also moving downward relative to the captured roller. As the trigger approaches the release position (e.g., as shown in FIGS. 4-7A), the captured roller engages parts of the first sear surface that are in an upper region "U" of the first sear surface (FIG. 8).

Figure 9:
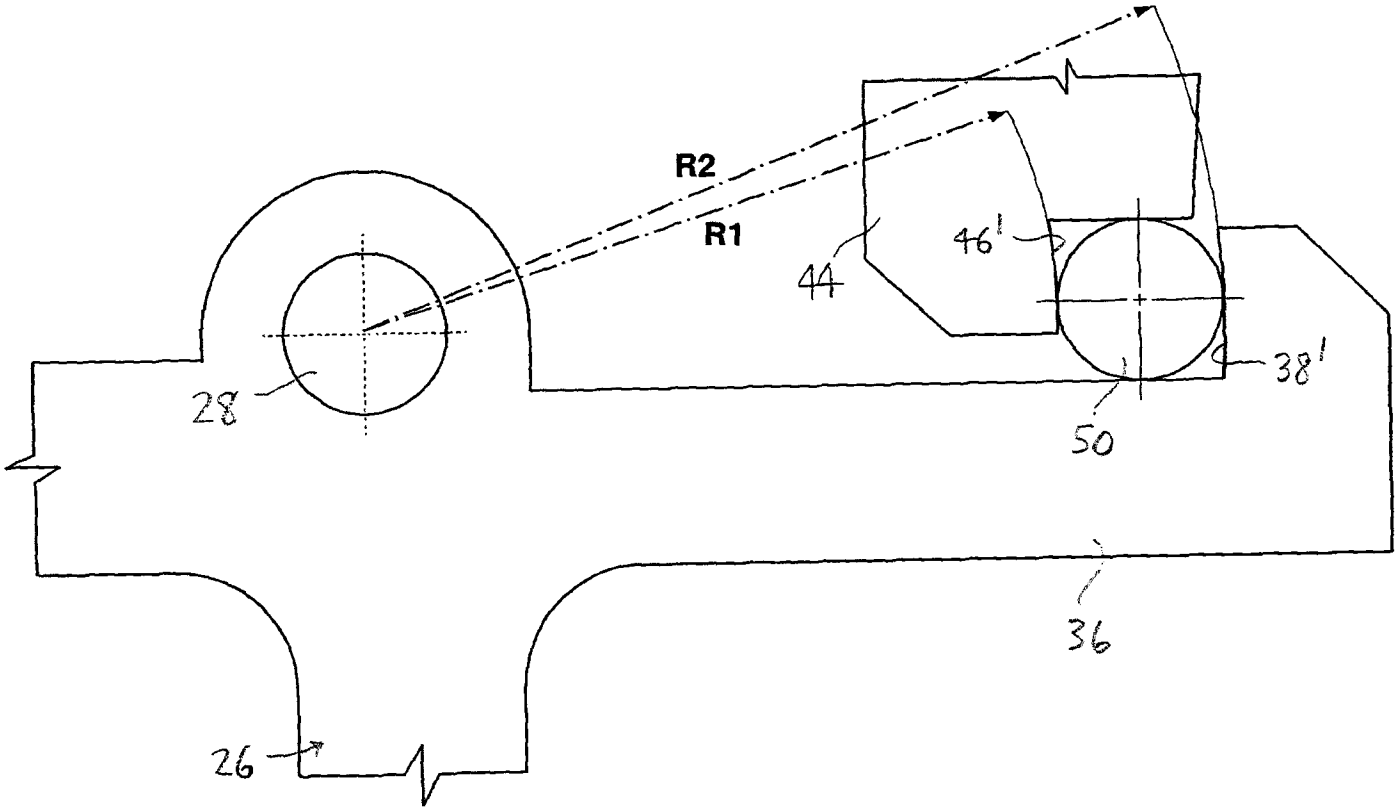
FIG. 9 is a side view of a portion of an alternative embodiment of the trigger assembly of the invention.

In one embodiment, either or both of the first and second sear surfaces 38', 46' preferably is at least partially concave. The results for this embodiment of the trigger assembly of the invention are graphically represented in the curve identified as "Embodiment (2)—FIG. 9" in FIG. 11. As can be seen in FIG. 9, in one embodiment of the trigger assembly, the first and second sear surfaces 38', 46' are at least partially concave. Preferably, the first and second sear surfaces 38', 46' preferably are both defined by respective radii "$R_1$", "$R_2$" from the trigger arm pivot point "$T_P$" so that the curvature of each of the sear surfaces 38', 46' is substantially the same. As can be seen in FIG. 9, the radii "$R_1$", "$R_2$" define arcs that are generally parallel to the arc defined by the downward pivoting of the sear arm 36 when the trigger 26 is pulled. Such arc is generally indicated by arrow "C" in FIG. 9. Accordingly, substantially no moment is generated in the operation of this embodiment. As can be seen in FIG. 11, as a result, the trigger pull load required to move the trigger from the load position to the release position is substantially the same throughout.

Figure 10A:
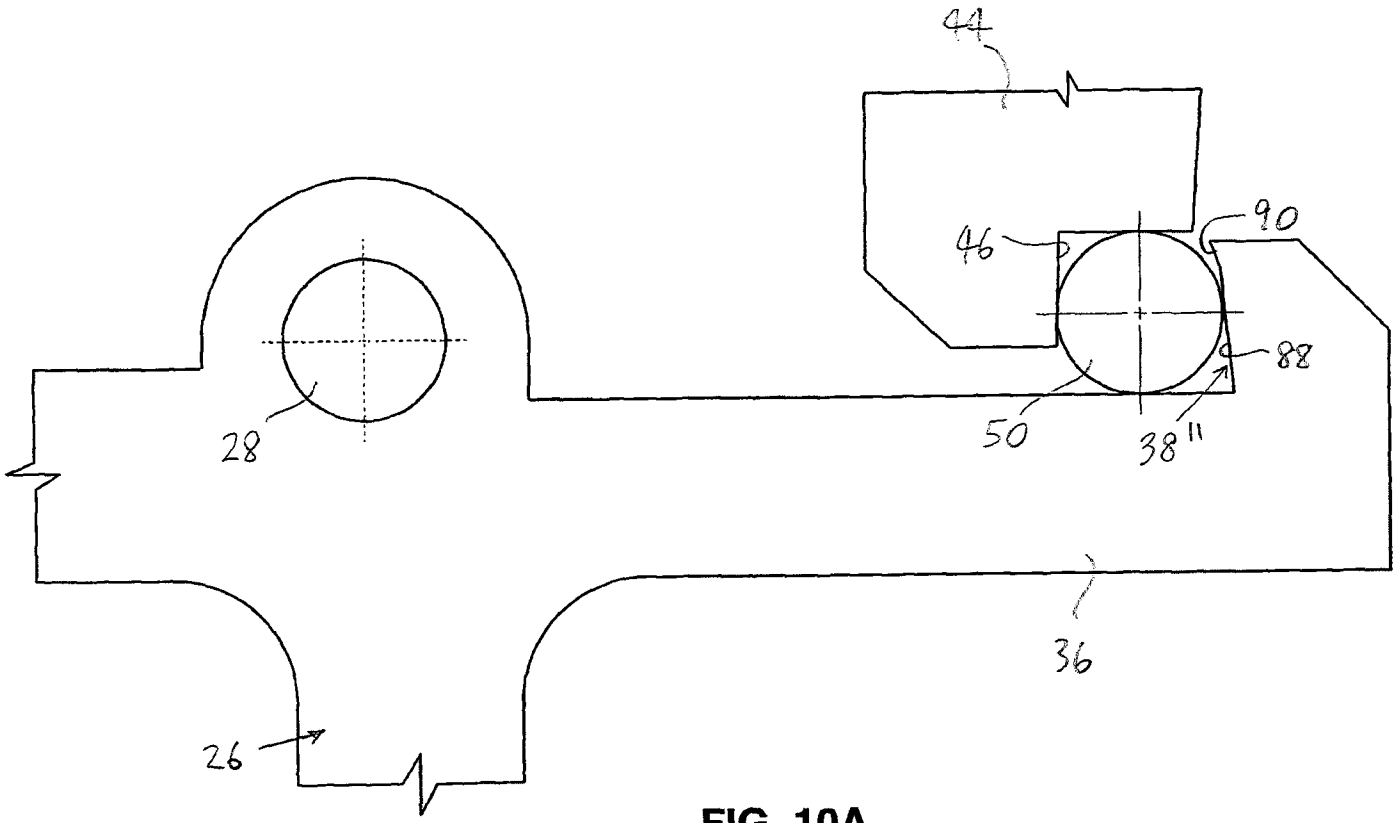
FIG. 10A is a side view of a portion of another alternative embodiment of the trigger assembly of the invention.
Figure 10B:
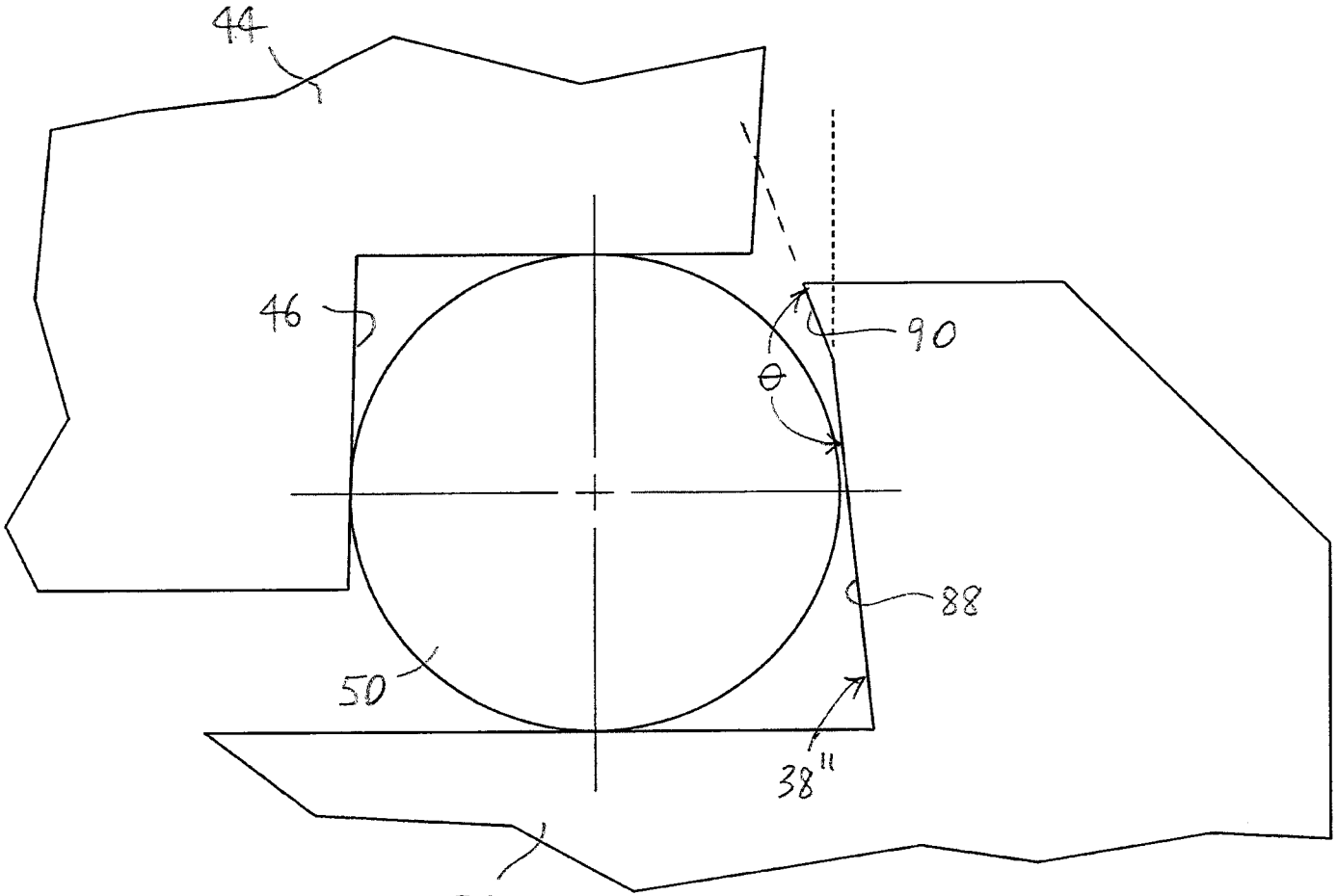
FIG. 10B is a portion of the embodiment illustrated in FIG. 10A, drawn at a larger scale.

In another embodiment of the trigger assembly shown in part in FIGS. 10A and 10B, the first and second sear surfaces are formed to cooperate to provide preselected rolling frictional resistance to movement of the trigger. As shown in FIGS. 10A and 10B, the first sear surface 38" preferably includes two or more substantially planar first and second surfaces 88, 90 defining an obtuse angle "θ" therebetween. In this embodiment, the second sear surface 46 preferably is substantially planar.

When the trigger is initially moved from the load position, the captured roller 50 is held between the first surface 88 and the second sear surface 46. As noted above, as the trigger moves toward its release position, the first sear surface moves downwardly relative to the second sear surface and the captured roller. Based on the foregoing, therefore, those skilled in the art would appreciate that as the trigger approaches the release position, the captured roller 50 is engaged by the second surface 90. Because the second surface 90 is slanted toward the second sear surface 46, the captured roller 50 is squeezed more tightly between the first and second sear surfaces 38", 46 when the roller 50 engages the second surface 90 than when the captured roller 50 is between the first surface 88 and the second sear surface. Those skilled in the art would also appreciate that, when the captured roller 50 is held between the second surface 90 and the second sear surface 46, because the captured roller 50 is more tightly held therebetween than between the first surface 88 and the second sear surface 46, more rolling frictional resistance is offered by the roller 50 to movement of the second sear surface 46 relative to the first sear surface 38". Accordingly, after the captured roller 50 engages the second surface 90, the trigger 26 is required to be squeezed harder in order to enable the firing element 40 to clear the captured roller 50.

The result of the configuration of the first sear surface 38" and the second sear surface 46 is represented in FIG. 11. As can be seen in the curve identified as "Embodiment (3)—FIGS. 10A, 10B", due to the positioning of the first and second surfaces 88, 90, a distinctly higher trigger pull load is required to be applied in order to release the bowstring after the trigger has reached a transition position, after a gradually increasing (but significantly lower) load is applied to move the trigger 26 over most of the arc 58. When the captured roller 50 first engages the second surface 90, the trigger 26 is at the transition position.

As shown in the example provided in FIG. 11, to move the trigger over most of the arc 58, a gradually increasing load of between about 0.7 and 0.8 pounds is applied. However, once the trigger 26 has reached the transition position (identified as "X" on the curve for "Embodiment (3)" in FIG. 11), in order to move the trigger through the last part of its arc to the release position, a load of approximately 1.0 pound is required to be applied.

In practice, this embodiment is advantageous because the user can pull the trigger through the arc to the transition position with confidence that the bowstring is not to be released until the transition position has been passed. Release is then accomplished by squeezing the trigger 26 to cause it to move through the final portion of the arc, i.e., from the transition position to its release position.

As can be seen in FIG. 11, squeezing the trigger 26, once the trigger 26 is at the transition position "X" in the arc 58, involves pivoting the trigger 26 through a very small portion of the arc 58, e.g., about 0.25°. It can be seen, therefore, that the trigger 26 can quickly be squeezed by the user for prompt release without applying significant force. However, the force required to move the trigger past the transition position "X" preferably is significantly greater than the force required to move the trigger to the transition position, as illustrated in FIG. 11.

In summary, and based on the foregoing, the first and second sear surfaces 38", 46 cooperate to permit the trigger 26 to be movable from the load position toward the release position upon application of a first trigger pull load on the trigger until the trigger reaches the transition position. The first and second sear surfaces 38", 46 also cooperate to permit the trigger 26 to be movable from the transition position toward the release position upon application of a second trigger pull load on the trigger. The captured roller is 50 is mounted in the housing 24 for rotation of the captured roller 50 about the central axis 64 and for movement of the captured roller 50 substantially transverse to the central axis 64 as the trigger 26 moves from the load position to the transition position to provide a substantially consistent first (rolling) frictional resistance to movement of the first and second sear surfaces 38", 46 relative to each other, and to provide a substantially consistent second (rolling) frictional resistance to movement of the first and second sear surfaces 38", 46 relative to each other as the trigger 26 moves from the transition position to the release position.

As described above, it is preferred that the second trigger pull load exceeds the first trigger pull load, to hinder activation of the firing mechanism. In particular, because the second pull load exceeds the first pull load, inadvertent activation of the firing mechanism is thereby hindered.

In summary, based on FIGS. 8-10B, it will be appreciated by those skilled in the art that the first and second sear surfaces may be formed in a number of ways in order to result in such trigger effort profile (i.e., trigger effort as a function of trigger rotation, as illustrated in FIG. 11) as is desired. For example, the first and second sear surfaces may be defined by arcs which may or may not have a common center point. As another example, one of the first and second sear surfaces may be defined by an arc, and the other may be defined by one or more planes.

Figure 12:
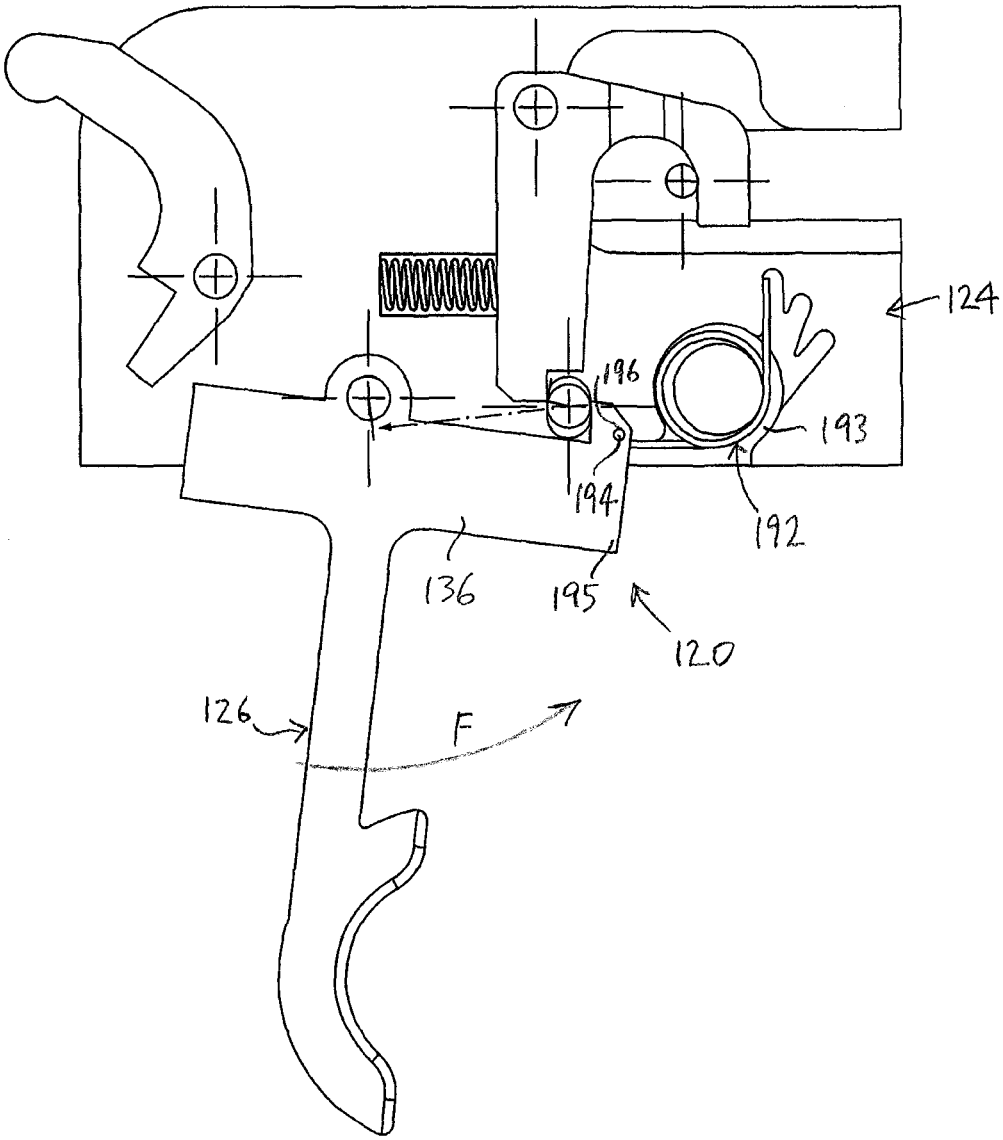
FIG. 12 is a side view of another alternative embodiment of the trigger assembly of the invention, drawn at a smaller scale.

Another embodiment of the trigger assembly 120 of the invention is illustrated in FIG. 12. Preferably, the trigger assembly 120 additionally includes a biasing means 192 for biasing a trigger 126 to the load position thereof. It is also preferred that the biasing means 192 is adjustable, to adjust a minimum trigger pull load for moving the trigger 126 from the load position and toward the release position.

The biasing means 192 preferably provides a way to "tune" the responsiveness of the trigger 126 to pressure from the user's finger. In one embodiment, and as illustrated in FIG. 12, the biasing means 192 preferably is a torsion spring positioned in a cavity 193 therefor in a housing 124. Preferably, an end 194 of the biasing means 192 is secured in a front end 195 of a sear arm 136 of the trigger 126. For instance, as illustrated in the exemplary embodiment of FIG. 12, the front end 195 preferably includes an aperture 196 in which the end 194 of the torsion spring 192 is positionable.

As can be seen in FIG. 12, the result is that the biasing means 192 urges the sear arm 136 to pivot generally upwardly, i.e., as indicated by arrow "F" in FIG. 12. It will be appreciated by those skilled in the art that, by modifying the relevant characteristics of the biasing means 192, the amount of force required to move the trigger 126 from the load position to the release position is correspondingly modified.

In one embodiment, the invention provides an embodiment of the device 54 (FIG. 1B) preferably including the trigger assembly 20. The device of the invention preferably also includes the trigger assembly 120, described above. For instance, the invention includes a crossbow including the trigger assembly of the invention. Alternatively, the invention includes a firearm including the trigger assembly of the invention.

Figure 13A:
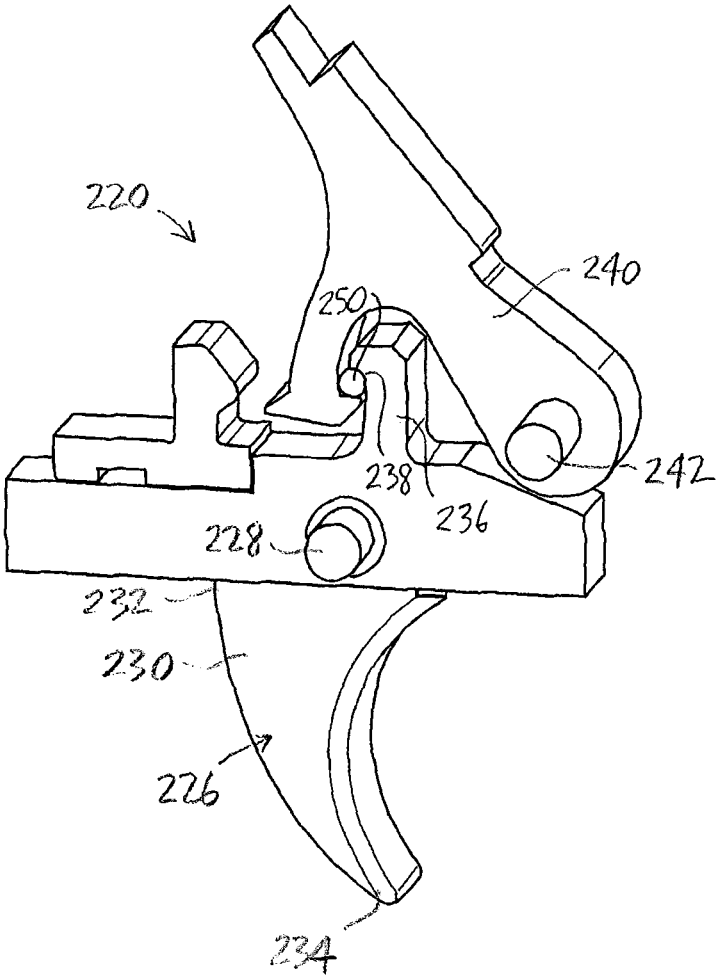
FIG. 13A is an isometric view of an alternative embodiment of the trigger assembly of the invention, drawn at a smaller scale.
Figure 13C:
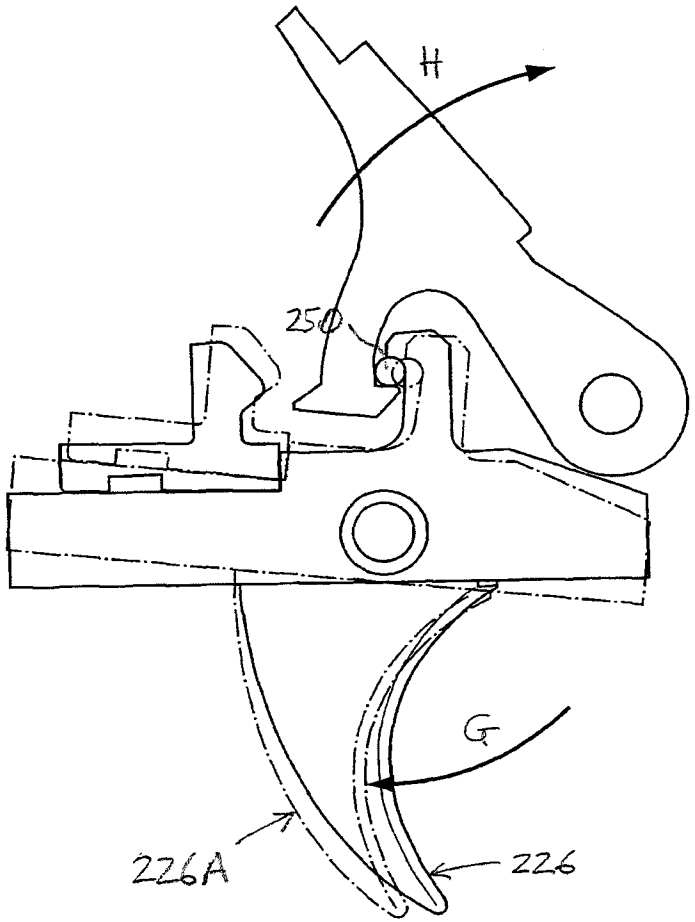
FIG. 13C is a side view of the trigger assembly of FIG. 13A, showing the trigger thereof in a load position and another, intermediate, position.
Figure 13B:
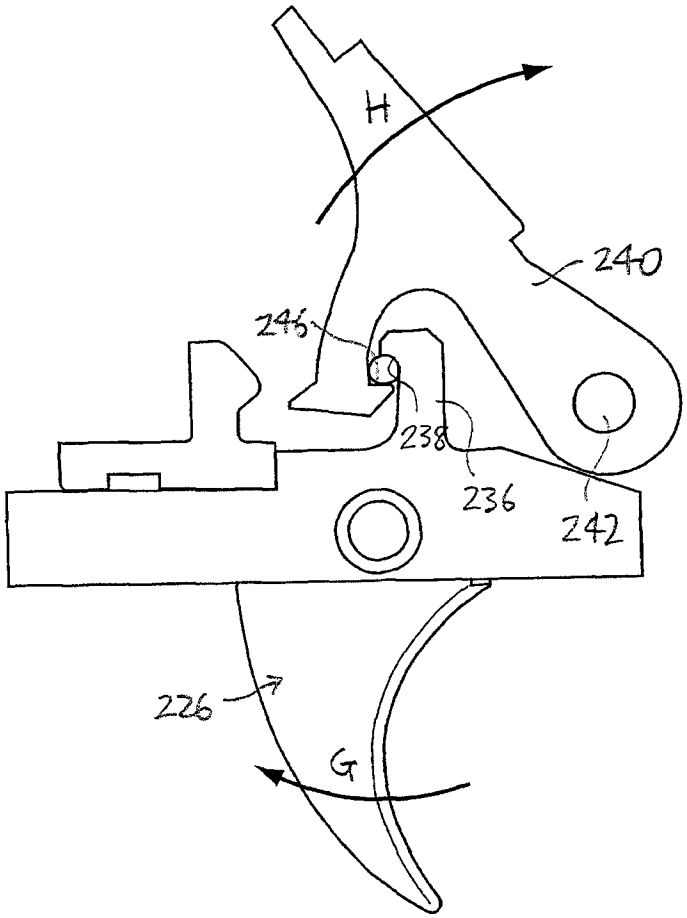
FIG. 13B is a side view of the trigger assembly of FIG. 13A.
Figure 13D:
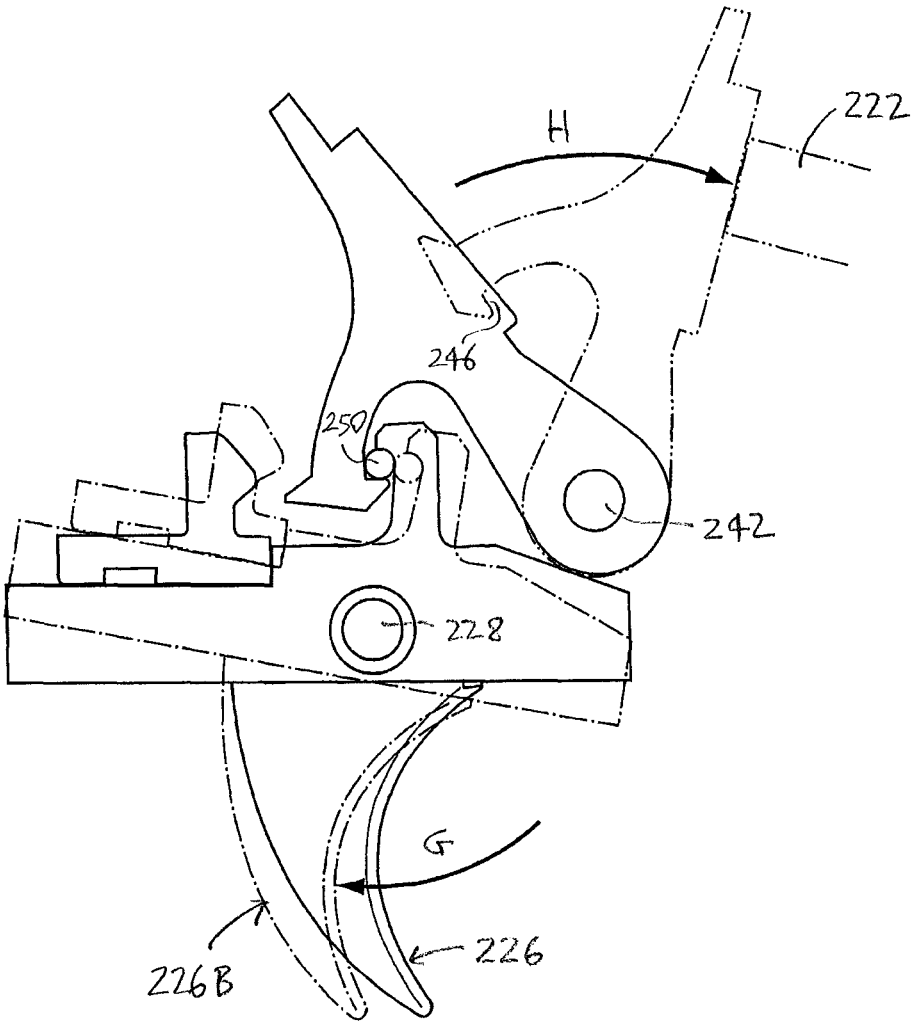
FIG. 13D is a side view of the trigger assembly of FIG. 13A in which the trigger is in a release position.
Figure 15:
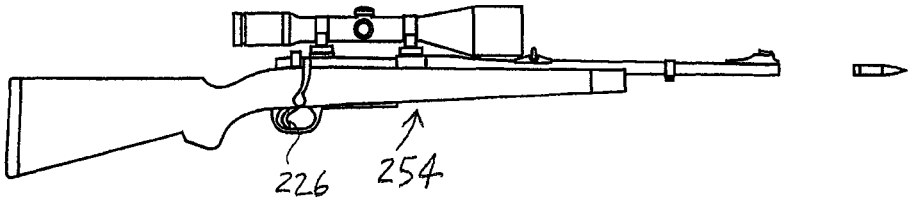
FIG. 15 is an isometric view of an embodiment of a firearm of the invention including the trigger assembly of the invention, drawn at a smaller scale.

As indicated above, the device of the invention may be any device including a firing mechanism activatable by movement of a trigger, and generally, the device is for firing or launching a projectile. An alternative embodiment of the trigger assembly 220 of the invention is shown in FIGS. 13A-13D. As will be described, the trigger assembly 220 is for use with a firing mechanism 222 (FIG. 13D) in a firearm 254 (FIG. 15). Preferably, the trigger assembly 220 includes a trigger 226 pivotally mounted on a trigger pivot pin 228 between a load position (FIGS. 13A, 13B) to a release position (FIG. 13D). The trigger 226 preferably includes a trigger arm 230 extending between a top end 232 and a bottom end 234. The trigger 226 preferably also includes a sear arm 236 including a first sear surface 238. In addition, the trigger assembly 220 preferably also includes a firing element 240 (i.e., a hammer) pivotally mounted on a firing element pivot pin 242. As can be seen in FIG. 13B, the trigger 226 preferably is pivotable in the direction indicated by arrow "G" in FIG. 13B. It is also preferred that the firing element 240 is biased in the direction indicated by arrow "H" in FIG. 13B by biasing means (not shown). Preferably, the firing element 240 includes a second sear surface 246. It is also preferred that a captured roller 250 is held between the first and second sear surfaces 238, 246 until the trigger 236 reaches the release position. The firing element 240 is pivotable between a first position (FIGS. 13A, 13B) in which the firing element 240 is held by the trigger 226, and a second position (FIG. 13D), in which the firing element 240 activates the firing mechanism 222.

When the user applies a trigger pull load on the trigger 226, the trigger pivots in the direction indicated by arrow "G". In FIG. 13C, the pivoting movement of the trigger 226 from the load position in the direction indicated by arrow "G" is shown by the dashed outline of the trigger 226, in which the trigger 226 is shown in an intermediate position. For clarity of illustration, the trigger, when located in the intermediate position (FIG. 13C), is identified by the reference numeral 226A.

Also, in FIG. 13D, the trigger 226 is shown in dashed outline in its release position. When located in the release position (FIG. 13D), the trigger is identified by the reference numeral 226B.

When the trigger 226 reaches the release position, the second sear surface 246 on the firing element 240 disengages from the captured roller 250, and urged by its biasing means, the firing element 240 pivots in the direction indicated by arrow "H" to its second position, where it activates the firing mechanism 222.

It will be understood that, for clarity of illustration, only a small portion of the firing mechanism 222 is shown in FIG. 13D. For instance, the part of the firing mechanism shown as being engaged by the firing element 240 is a firing pin of the device 254. The firing pin as shown in FIG. 13D is exemplary only. As noted above, the trigger assembly may activate the firing mechanism in various ways, depending on the firing mechanism. For instance, instead of activation by striking the firing pin (as shown in FIG. 13D), the firing mechanism may be activated by release of the firing pin.

It will also be understood that the trigger assembly 220 may have any of the features described above in connection with other embodiments of the trigger assembly. For instance, although the sear surfaces 238, 246 are shown as being substantially planar, it will be understood that the sear surfaces in the trigger assembly included in firearms may have various configurations (e.g., as shown in FIGS. 9, 10A, and 10B).

Figure 14A:
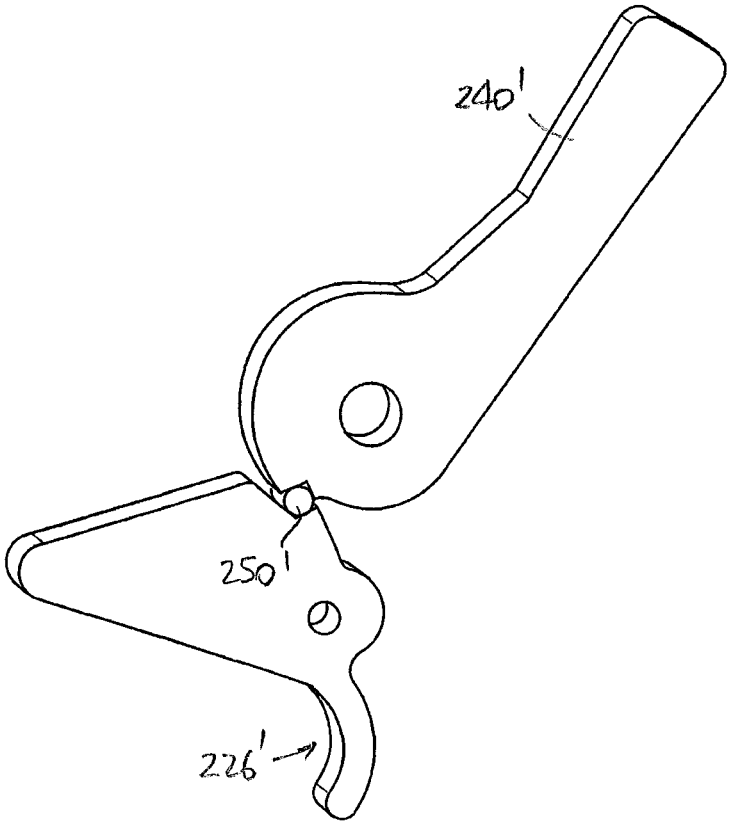
FIG. 14A is an isometric view of another alternative embodiment of the trigger assembly of the invention, drawn at a smaller scale.
Figure 14C:
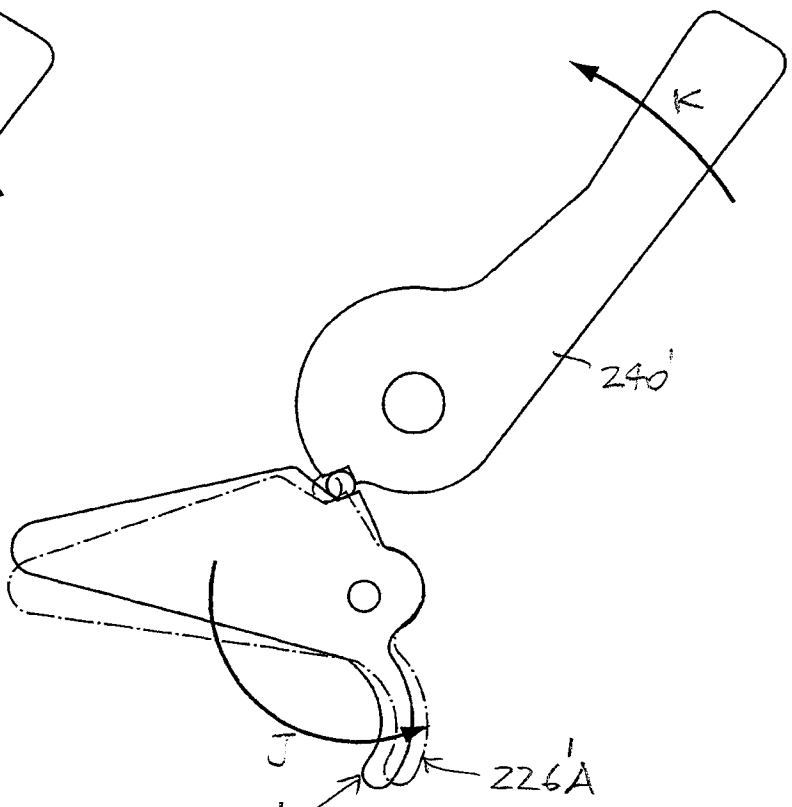
FIG. 14C is a side view of the trigger assembly of FIG. 14A, showing the trigger thereof in a load position and another, intermediate, position.
Figure 14B:
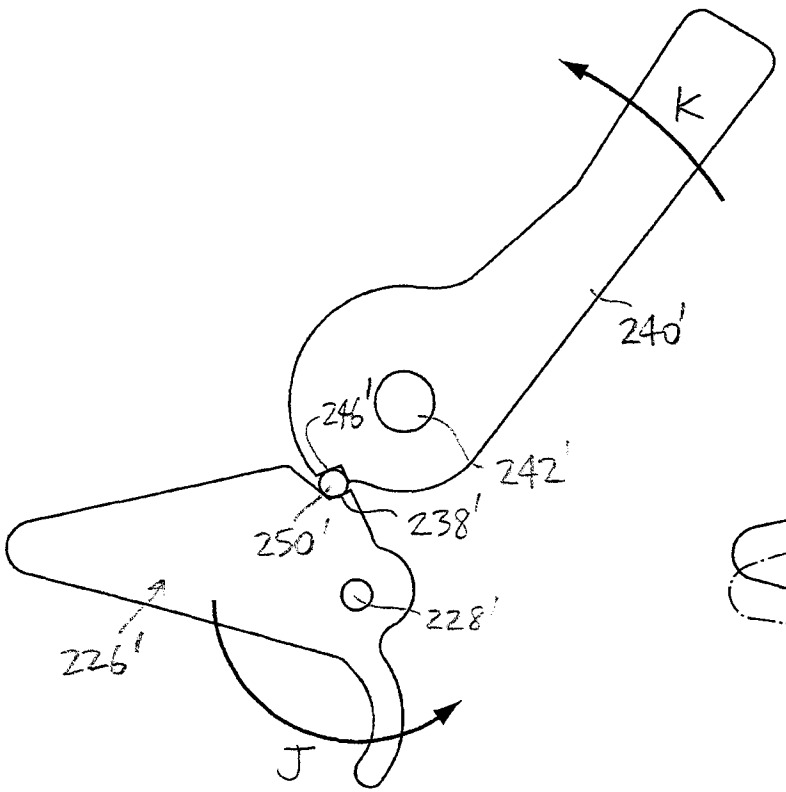
FIG. 14B is a side view of the trigger assembly of FIG. 14A.
Figure 14D:
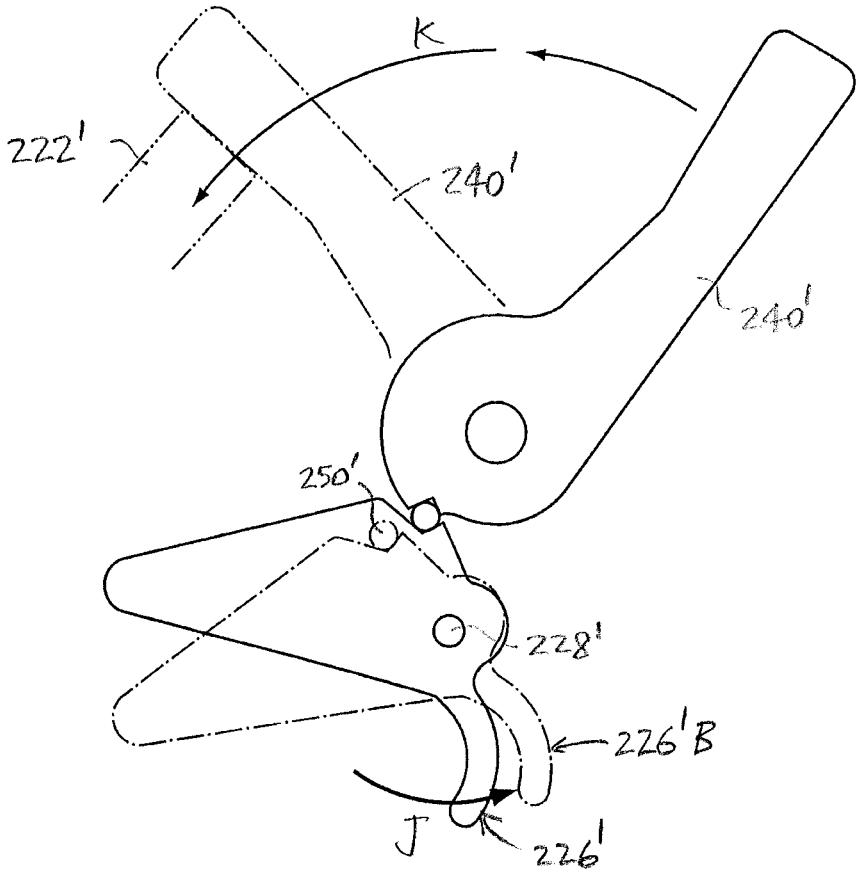
FIG. 14D is a side view of the trigger assembly of FIG. 14A showing the trigger in a release position.

An alternative embodiment of the trigger assembly 220' is illustrated in FIGS. 14A-14D. As will be described, the trigger assembly 220' is for use with a firing mechanism 222' (FIG. 14D) in the firearm 254 (FIG. 15). Preferably, the trigger assembly 220' includes a trigger 226' pivotally mounted on a trigger pivot pin 228' between a load position (FIGS. 14A, 14B) to a release position (FIG. 14D). The trigger 226' preferably includes a trigger arm 230' extending between a top end 232' and a bottom end 234'. The trigger 226' preferably also includes a sear arm 236' including a first sear surface 238'. In addition, the trigger assembly 220' preferably also includes a firing element 240' (i.e., a hammer) pivotally mounted on a firing element pivot pin 242'. As can be seen in FIG. 14B, the trigger 226' preferably is pivotable in the direction indicated by arrow "J" in FIG. 14B, when a trigger pull load is applied to the trigger. It is also preferred that the firing element 240' is biased in the direction indicated by arrow "K" in FIG. 14B by biasing means (not shown). Preferably, the firing element 240' includes a second sear surface 246'. It is also preferred that a captured roller 250' is held between the first and second sear surfaces 238', 246' until the trigger 236' reaches the release position. The firing element 240' is pivotable between a first position (FIGS. 14A, 14B) in which the firing element 240' is held by the trigger 226', and a second position (FIG. 14D), in which the firing element 240' activates the firing mechanism 222'.

When the user applies a trigger pull load on the trigger 226', the trigger pivots in the direction indicated by arrow "J". In FIG. 14C, the pivoting movement of the trigger 226' from the load position in the direction indicated by arrow "J" is shown by the dashed outline of the trigger 226', in which the trigger 226' is shown in an intermediate position. For convenience, the trigger, when located in the intermediate position (FIG. 14C), is identified by the reference numeral 226'A.

Also, in FIG. 14D, the trigger 226' is shown in dashed outline in its release position. When located in the release position (FIG. 14D), the trigger is identified by the reference numeral 226'B.

When the trigger 226' reaches the release position, the second sear surface 246' on the firing element 240' disengages from the captured roller 250', and urged by its biasing means, the firing element 240' pivots in the direction indicated by arrow "K" to its second position, where it activates the firing mechanism 222.

It will be understood that, for clarity of illustration, only a small portion of the firing mechanism 222' is shown in FIG. 14D. For instance, the part of the firing mechanism shown as being engaged by the firing element 240' is a firing pin of the device 254. The firing pin as shown in FIG. 14D is exemplary only. As noted above, the trigger assembly may activate the firing mechanism in various ways, depending on the firing mechanism. For instance, instead of activation by striking the firing pin (as shown in FIG. 14D), the firing mechanism may be activated by release of the firing pin.

It will also be understood that the trigger assembly 220' may have any of the features described above in connection with other embodiments of the trigger assembly. For instance, although the sear surfaces 238', 246' are shown as being substantially planar, it will be understood that the sear surfaces in the trigger assembly included in firearms may have various configurations (e.g., as shown in FIGS. 9, 10A, and 10B).

It will be appreciated by those skilled in the art that the invention can take many forms, and that such forms are within the scope of the invention as described above. The foregoing descriptions are exemplary, and their scope should not be limited to the preferred versions provided therein.

I claim:

1. A trigger assembly for activating a firing mechanism, the trigger assembly being mountable in a housing, the trigger assembly comprising:

a trigger pivotally mounted on a trigger pivot pin, the trigger comprising:

an elongate trigger arm extending between a top end proximal to the trigger pivot pin and a bottom end distal to the trigger pivot pin;

a sear arm positioned transverse to the trigger arm, the sear arm comprising a first sear surface;

a firing element pivotally mounted on a firing element pivot pin, the firing element comprising:

a body portion comprising a second sear surface;

an engagement portion for engagement with at least a portion of the firing mechanism, for activating the firing mechanism;

a captured roller positioned for engagement with the first and second sear surfaces;

the trigger being pivotable about the trigger pivot pin between a load position, in which the captured roller is held between the first and second sear surfaces, and a release position, in which the second sear surface is disengaged from the captured roller and the firing element is released; and the firing element being pivotable about the firing element pivot pin between a first position, in which the firing element is held by the engagement of the second sear surface with the captured roller when the trigger is in the load position thereof and the firing mechanism is activatable by the engagement portion, and a second position, in which the firing element is disengaged from the captured roller and the firing mechanism is activated by the engagement portion, the firing element being movable to the second position upon the trigger moving to the release position thereof.

2. A trigger assembly according to claim 1 in which:

the captured roller is elongate and at least partially defines a central axis thereof; and the captured roller is mounted in the housing for rotation of the captured roller about the central axis and for movement of the captured roller substantially transverse to the central axis as the trigger moves from the load position to the release position to provide substantially consistent frictional resistance to movement of the first and second sear surfaces relative to each other.

3. A trigger assembly according to claim 2 in which the captured roller is at least partially positioned in a pair of apertures formed in the housing to permit limited transverse movement of the captured roller.

4. A trigger assembly according to claim 1 in which the firing element is biased to the second position.

5. A trigger assembly according to claim 1 in which the first and second sear surfaces are at least partially planar.

6. A trigger assembly according to claim 1 in which at least one of the first and second sear surfaces is at least partially concave.

7. A trigger assembly according to claim 1 in which the first sear surface comprises at least two substantially planar surfaces defining an obtuse angle therebetween.

8. A trigger assembly according to claim 1 in which:

the first and second sear surfaces cooperate to permit the trigger to be movable from the load position toward the release position upon application of a first trigger pull load on the trigger until the trigger reaches a transition position; and the first and second sear surfaces cooperate to permit the trigger to be movable from the transition position toward the release position upon application of a second trigger pull load on the trigger.

9. A trigger assembly according to claim 8 in which:

the captured roller is elongate and at least partially defines a central axis thereof; and the captured roller is mounted in the housing for rotation of the captured roller about the central axis and for movement of the captured roller substantially transverse to the central axis as the trigger moves from the load position to the transition position to provide a substantially consistent first frictional resistance to movement of the first and second sear surfaces relative to each other, and to provide a substantially consistent second frictional resistance to movement of the first and second sear surfaces relative to each other as the trigger moves from the transition position to the release position.

10. A trigger assembly according to claim 8 in which the second trigger pull load exceeds the first trigger pull load, to hinder activation of the firing mechanism.

11. A trigger assembly according to claim 8 in which the first and second sear surfaces cooperate to at least partially impede transverse movement of the captured roller once the trigger reaches the transition point, to provide that the second trigger pull load exceeds the first trigger pull load.

12. A trigger assembly according to claim 1 additionally comprising a biasing means for biasing the trigger to the load position.

13. A trigger assembly according to claim 12 in which the biasing means is adjustable, to adjust a minimum trigger pull load for moving the trigger from the load position and toward the release position.

14. A device for firing a projectile comprising the trigger assembly according to claim 1.

15. A trigger assembly for mounting in a housing in a crossbow, the housing having an opening at a forward side thereof in which a bowstring is at least partially positionable in a drawn position thereof, the trigger assembly comprising:

a trigger pivotally mounted on a trigger pivot pin supported in the housing, the trigger comprising:

an elongate trigger arm extending between a top end proximal to the trigger pivot pin and a bottom end distal thereto;

a sear arm positioned transverse to the trigger arm, the sear arm comprising a first sear surface;

a firing element pivotally mounted on a firing element pivot pin supported in the housing, the firing element comprising:

a body portion comprising a second sear surface;

a hook portion;

a captured roller positioned for engagement with the first and second sear surfaces; the trigger being pivotable about the trigger pivot pin between a load position, in which the captured roller is held between the first and second sear surfaces, and a release position, in which the second sear surface is disengaged from the captured roller and the firing element is released; and the firing element being pivotable about the firing element pivot pin between:

a hooked position, in which the firing element is held by the engagement of the second sear surface with the captured roller when the trigger is in the load position thereof and the firing mechanism is activatable by the engagement portion, the bowstring being retainable by the hook portion when the firing element is in the hooked position; and an open position, in which the firing element is disengaged from the captured roller and the bowstring is releasable from the firing element, the firing element being movable to the open position upon the trigger moving to the release position thereof.

16. A trigger assembly according to claim 15 in which:

the captured roller is elongate and at least partially defines a central axis thereof; and the captured roller is mounted in the housing for rotation of the captured roller about the central axis and for movement of the captured roller in at least one direction substantially transverse to the central axis as the trigger moves from the load position to the release position to provide substantially consistent frictional resistance to movement of the first and second sear surfaces relative to each other.

17. A trigger assembly according to claim 16 in which the captured roller is at least partially positioned in a pair of apertures formed in the housing to permit limited transverse movement of the captured roller.

18. A trigger assembly according to claim 15 in which the firing element is biased to the open position.

19. A trigger assembly according to claim 18 additionally comprising a resilient element supported in the housing and engaged to the catch, for biasing the firing element to the open position thereof.

20. A trigger assembly according to claim 15 in which the first and second sear surfaces are at least partially planar.

21. A trigger assembly according to claim 15 in which at least one of the first and second sear surfaces is at least partially concave.

22. A trigger assembly according to claim 15 in which the first sear surface comprises at least two substantially planar surfaces defining an obtuse angle therebetween.

23. A trigger assembly according to claim 15 in which:

the first and second sear surfaces cooperate to permit the trigger to be movable from the load position toward the release position upon application of a first trigger pull load on the trigger until the trigger reaches a transition position; and the first and second sear surfaces cooperate to permit the trigger to be movable from the transition position toward the release position upon application of a second trigger pull load on the trigger.

24. A trigger assembly according to claim 23 in which:

the captured roller is elongate and at least partially defines a central axis thereof; and the captured roller is mounted in the housing for rotation of the captured roller about the central axis and for movement of the captured roller substantially transverse to the central axis as the trigger moves from the load position to the transition position to provide a substantially consistent first frictional resistance to movement of the first and second sear surfaces relative to each other, and to provide a substantially consistent second frictional resistance to movement of the first and second sear surfaces relative to each other as the trigger moves from the transition position to the release position.

25. A trigger assembly according to claim 23 in which the second trigger pull load exceeds the first trigger pull load, to hinder inadvertent activation of the firing mechanism.

26. A trigger assembly according to claim 23 in which the first and second sear surfaces cooperate to at least partially impede transverse movement of the captured roller once the trigger reaches the transition point, to provide that the second trigger pull load exceeds the first trigger pull load.

27. A trigger assembly according to claim 15 additionally comprising a biasing means for biasing the trigger to the load position.

28. A trigger assembly according to claim 27 in which the biasing means is adjustable, to adjust a minimum trigger pull load for moving the trigger from the load position and toward the release position.

29. A crossbow comprising the trigger assembly according to claim 15.

* * * * *